US006140565A

United States Patent [19]

Yamauchi et al.

[11] Patent Number: 6,140,565

[45] Date of Patent: Oct. 31, 2000

[54] METHOD OF VISUALIZING MUSIC SYSTEM BY COMBINATION OF SCENERY PICTURE AND PLAYER ICONS

[75] Inventors: Akira Yamauchi; Manabu Kawada; Yasuhiko Okamura; Yasushi Kurakake; Kenichiro Saito; Yoshiko Fukushima, all of Hamamatsu, Japan

[73] Assignee: Yamaha Corporation, Japan

[21] Appl. No.: 09/326,987

[22] Filed: Jun. 7, 1999

[30] Foreign Application Priority Data

Jun. 8, 1998 [JP] Japan ..... 10-159269
Jun. 8, 1998 [JP] Japan ..... 10-159270
Jun. 8, 1998 [JP] Japan ..... 10-159271

[51] Int. Cl.[7] ..... G10H 7/00

[52] U.S. Cl. ..... 84/600; 84/612; 84/622; 84/633; 84/636; 84/477 R; 84/DIG. 6

[58] Field of Search ..... 84/612, 622–625, 84/652, 659–661, 668, 477 R, 478, 724, DIG. 6

[56] References Cited

U.S. PATENT DOCUMENTS 5,027,689 7/1991 Fujimori .
5,085,116 2/1992 Nakata et al. ..... 84/477 R X
5,153,829 10/1992 Furuya et al. ..... 84/477 R X
5,286,908 2/1994 Jungleib ..... 84/DIG. 6
5,300,727 4/1994 Osuga et al. ..... 84/622
5,739,454 4/1998 Kunimoto ..... 84/622 X
5,918,303 6/1999 Yamaura et al. ..... 84/612 X
5,925,843 7/1999 Miller et al. ..... 84/477 R X

FOREIGN PATENT DOCUMENTS 3-200287 9/1991 Japan .

*Primary Examiner*—Stanley J. Witkowski
*Attorney, Agent, or Firm*—Morrison & Foerster LLP

[57] ABSTRACT

A method is designed for displaying a visual image of a music system that is constructed to play at least one performance part with a particular timbre and that is applied with an acoustic effect, an accompaniment style and the like. The method is carried out by the steps of analyzing data associated to the music system to discriminate the acoustic effect, the accompaniment style and the like applied to the music system and to discriminate the particular timbre allotted to the performance part of the music system, providing a picture of a scenery setting in matching with the discriminated acoustic effect, the accompaniment style and the like such that the picture of the scenery setting visualizes a situation and environment in which the music system should be played with the acoustic effect, the accompaniment style and the like, providing an icon in correspondence to the discriminated particular timbre such that the icon symbolizes playing of the performance part with the allotted timbre, and arranging the icon of the performance part in the picture of the scenery setting to thereby synthesize the visual image of the music system.

44 Claims, 19 Drawing Sheets

| MUSIC GENRE | TEMO | MELODY/ BACKING | SAMPLE MUSIC DATA |
|---|---|---|---|
| CLASSICAL | QUICK | MELODY | 1 |
| | | BACKING | 2 |
| | SLOW | MELODY | 3 |
| | | BACKING | 4 |
| POPS | QUICK | MELODY | 5 |
| | | BACKING | 6 |
| ⋮ | ⋮ | ⋮ | ⋮ |

FIG.18

| MUSIC GENRE | MUSIC TITLE |
|---|---|
| CLASSICAL | |
| | TITLE A |
| | TITLE B |
| JAZZ | |
| | TITLE C |
| ⋮ | ⋮ |

FIG.19

| AUTO BACKING STYLE | STAGE EFFCT (REVERBERATION) | PERFORMANCE SITUATION IMAGE |
|---|---|---|
| DANCING | NONE | 1 |
| | HALL | 2 |
| | STAGE | 3 |
| CLASSICAL | NONE | 4 |
| | HALL | 5 |
| | STAGE | 6 |
| JAZZ | NONE | 7 |
| | HALL | 8 |
| | STAGE | 9 |
| ROCK | NONE | 10 |
| | HALL | 11 |
| | STAGE | 12 |
| FOLK A | NONE | 13 |
| | HALL | 14 |
| | STAGE | 15 |
| FOLK B | NONE | 16 |
| | HALL | 17 |
| | STAGE | 18 |
| TROPICAL | NONE | 19 |
| | HALL | 20 |
| | STAGE | 21 |

METHOD OF VISUALIZING MUSIC SYSTEM BY COMBINATION OF SCENERY PICTURE AND PLAYER ICONS

BACKGROUND OF THE INVENTION

1. Field of the Invention

The present invention generally relates to a technology of visually representing a music system composed of performance parts.

The present invention also relates to a technology of setting sample music data for auditioning timbres of the performance parts in a sequencer or an electronic musical instrument.

2. Description of Related Art

With a dedicated sequencer machine or a personal-computer-based desktop music (DTM) machine, a sound having a timbre assigned to each performance part is reproduced for performance by means of step-recording based on note specification by use of a pointing device such as a mouse, or real-time recording based on live performance by use of a MIDI (Musical Instrument Digital Interface) keyboard, or by reading a music data file. In doing so, it would be helpful to display symbols representing timbres of performance parts onto a display screen, thereby making the dedicated sequencer or the DTM familiar to novice users. However, simple displaying of these symbols makes the display screen monotonous, and provides no association with an impression of performance. Also known is a device that teaches tempo by means of sounds or visual information. However, this device indicates the tempo only during music reproduction.

In DTM, it is essential for music creation to select a timbre for each performance part of a music system such as orchestra and band. It is a general practice to test-listen to a timbre for timbre selection by operating a real keyboard connected to a personal computer or by a software keyboard displayed on a monitor screen. However, some of the recently developed tone generators or sequencers provide an auditioning capability that allows users to audibly test a sound of specified timbre at a predetermined interval or in distributed chord by operating a button switch on a tone generator or by clicking a mouse on a monitor screen. This test-listening capability is gene rally referred to as an audition capability.

A problem of such a device is that, once sounded in a constant pitch or a constant sequence, any timbre is heard hardly distinctively from others. Especially, the appropriate selection of timbres Is difficult for novice users, so that they cannot create music as desired. Music data for use in audition must be suitable for a user operating environment. For example, in terms of music genre, If a user makes audition by pops-type music while attempting to create classical-type music, the user is given a wrong image of timbre. In terms of music style, if a user makes audition with a slow melody while attempting to create a quick tune, the user is also given a wrong image. Further, in music pieces of the same genre, a different impression is given when a certain timbre is used in melody and in backing (or accompaniment). Thus, conventionally, the music data for use in audition has not been studied much.

SUMMARY OF THE INVENTION

It is therefore a first object of the present invention to provide a method for visually representing a music system composed of one or more performance parts.

It is a second object of the present invention to provide a method capable of displaying a performance state of a performance part, by changing the state of an icon representing the timbre of the performance part.

It is a third object of the present invention to provide a method of setting sample music data which allows a user to easily evaluate differences among timbres, and which is suited to a user interface environment.

In a first aspect, the inventive method is designed for displaying a visual image of a music system that is constructed to play at least one performance part with a particular timbre and that is acoustically characterized by a specific effect. The inventive method is carried out by the steps of analyzing data representative of the music system to discriminate the specific effect applied to the music system and to discriminate the particular timbre allotted to the performance part of the music system, providing a picture of a virtual setting in matching with the discriminated specific effect such that the picture of the virtual setting visualizes a situation and environment in which the music system should be played with the specific effect, providing an icon in correspondence with the discriminated particular timbre such that the icon symbolizes playing of the performance part with the allotted timbre, and arranging the icon of the performance part in the picture of the virtual setting to thereby synthesize the visual image of the music system.

In a second aspect, the inventive method is designed for displaying a visual image of a music system that is constructed to play at least one performance part with a particular timbre and that is accompanied by a specific style of an accompaniment. The inventive method is carried out by the steps of analyzing data associated to the music system to discriminate the specific style applied to the music system and to discriminate the particular timbre allotted to the performance part of the music system, providing a picture of a virtual setting in matching with the discriminated specific style such that the picture of the virtual setting visualizes a situation and environment in which the music system should be played with the specific style, providing an icon in correspondence with the discriminated particular timbre such that the icon symbolizes playing of the performance part with the allotted timbre, and arranging the icon of the performance part in the picture of the virtual setting to thereby synthesize the visual image of the music system.

In a third aspect, the inventive method is designed for displaying a visual image of a music system that is constructed to play at least one performance part with a particular timbre and that is applied with a specific combination of an acoustic effect and an accompaniment style. The inventive method is carried out by the steps of analyzing data associated to the music system to discriminate the specific combination of the acoustic effect and the accompaniment style applied to the music system and to discriminate the particular timbre allotted to the performance part of the music system, providing a picture of a virtual setting in matching with the discriminated specific combination of the acoustic effect and the accompaniment style such that the picture of the virtual setting visualizes a situation and environment in which the music system should be played with the specific combination of the acoustic effect and the accompaniment style, providing an icon in correspondence with the discriminated particular timbre such that the icon symbolizes playing of the performance part with the allotted timbre, and arranging the icon of the performance part in the picture of the virtual setting to thereby synthesize the visual image of the music system.

In a fourth aspect, the inventive method is designed for displaying a visual image of a music system that is constructed to play at least one performance part with a particular timbre and a desired lateral pan. The inventive method is carried out by the steps of analyzing data representative of the music system to discriminate the particular timbre allotted to the performance part of the music system, providing an icon in correspondence with the discriminated particular timbre such that the icon symbolizes playing of the performance part with the allotted timbre, providing a picture of a virtual setting to visualize a situation and environment designed for the music system, the picture of the virtual setting being divided into a sensitive zone and an insensitive zone, locating the icon of the performance part at a desired lateral position in the picture of the virtual setting to thereby synthesize the visual image of the music system, determining the lateral pan of the performance part dependently on the lateral position of the icon when the icon is located within the sensitive zone of the picture, and otherwise determining a flat lateral pan for the performance part regardless of the lateral position of the icon when the icon is located within the insensitive zone of the picture. Preferably, the step of providing a picture comprises providing a picture of a virtual setting to visualize a three-dimensional situation and environment having depth positions such that the icon can be located at a depth position in addition to the lateral position. In such a case, the inventive method includes a step of determining a sound volume of the performance part dependently on the depth position of the icon located in the picture.

In a fifth aspect, the inventive method is designed for displaying a visual image of a music system that is constructed to play at least one performance part with a particular timbre and a lateral pan. The inventive method is carried out by the steps of analyzing data associated to the music system to discriminate the particular timbre allotted to the performance part of the music system and to discriminate the lateral pan applied to the performance part, providing an icon in correspondence with the discriminated particular timbre such that the icon symbolizes playing of the performance part with the allotted timbre, providing a picture of a virtual setting to visualize a situation and environment designed for the music system, and locating the icon of the performance part at a lateral position in the picture of the virtual setting in accordance with the discriminated lateral pan to thereby synthesize the visual image of the music system.

In a sixth aspect, the inventive method is designed for displaying a visual image of a music system that is constructed to play at least one performance part with a particular timbre and a sound volume. The inventive method is carried out by the steps of analyzing data representative of the music system to discriminate the particular timbre allotted to the performance part of the music system and to detect the sound volume set to the performance part, providing an icon in correspondence with the discriminated particular timbre such that the icon symbolizes playing of the performance part with the allotted timbre, providing a picture of a virtual setting to visualize a three-dimensional situation and environment having depth positions for accommodating the music system, and locating the icon of the performance part at a depth position in the picture of the virtual setting in accordance with the detected sound volume to thereby synthesize the visual image of the music system.

In a seventh aspect, the inventive method is designed for displaying a visual image of playing at least one performance part with a particular timbre in a music system. The inventive method is carried out by the steps of analyzing data representative of the music system to discriminate the particular timbre allotted to the performance part of the music system, synthesizing a picture containing an icon designed in correspondence with the a discriminated particular timbre, generating a sound having the particular timbre according to the data of the music system to thereby play the performance part of the music system, and animating the icon in matching with the sound so that the icon visualizes the playing of the performance part with the allotted timbre.

In an eighth aspect, the inventive method is designed for displaying a visual image of playing a music system containing at least one performance part having a particular timbre. The inventive method is carried out by the steps of analyzing data representative of the music system to discriminate the particular timbre allotted to the performance part of the music system, synthesizing a picture containing a player icon corresponding to the discriminated particular timbre and symbolizing the performance part of the music system, and a conductor icon symbolizing a conductor of the music system, generating a sound according to the data of the music system to thereby play the music system, and animating the conductor icon in matching with the sound so as to visualize the playing of the music system.

In a ninth aspect, the inventive method is designed for determining a sample of music data for use in auditioning a timbre allotted to a performance part of a music system. The inventive method is carried out by the steps of analyzing data representative of the music system to discriminate timbres allotted to performance parts constituting the music system, providing icons in correspondence with the discriminated timbres such that the icons symbolize playing of the performance parts with the allotted timbres, providing a picture of a virtual setting to visualize a situation and environment of the music system, arranging the icons of the performance parts in the picture of the virtual setting to thereby synthesize a visual image of the music system, and selecting one of the icons arranged in the visual image of the music system so as to determine a sample of music data for use in auditioning the timbre allotted to the selected performance part of the music system.

In a tenth aspect, the inventive method is designed for determining a sample of music data for use in auditioning a performance part of a music system that is applicable to perform a music of various genres. The inventive method is carried out by the steps of identifying a music genre to be performed by the music system, analyzing data representative of the music system to discriminate a timbre allotted to the performance part of the music system, and determining a sample of music data for use in auditioning the performance part according to the identified genre and the discriminated timbre.

In an eleventh aspect, the inventive method is designed for determining a sample of music data for use in auditioning a performance part of a music system that is adaptable to perform a music at a variable tempo. The inventive method is carried out by the steps of specifying a tempo of the music to be performed by the music system, analyzing data representative of the music system to discriminate a timbre allotted to the performance part of the music system, and determining a sample of music data for use in auditioning the performance part according to the specified tempo and the discriminated timbre.

In a twelfth aspect, the inventive method is designed for determining a sample of music data for use in auditioning performance parts of a music system. The inventive method is carried out by the steps of analyzing data representative of the music system to discriminate timbres allotted to the performance parts constituting the music system, providing icons in correspondence with the discriminated timbres such that the icons symbolize playing of the performance parts with the allotted timbres, providing a picture of a virtual setting to visualize a situation and environment of the music system, the picture containing a melody area and a backing area, arranging a location of each icon of each performance part in either of the melody area and the backing area on the picture of the virtual setting to thereby synthesize a visual image of the music system, some performance part being allocated to the melody area for playing a melody while other performance part being allocated to the backing area for backing the melody, and selecting one of the icons arranged in the visual image of the music system so as to determine a sample of music data for use in auditioning the performance part of the selected icon, according to the timbre allotted to the performance part of the selected icon and according to the location of the selected icon relative to the melody area and the backing area.

BRIEF DESCRIPTION OF THE DRAWINGS

These and other objects of the invention will be seen by reference to the description, taken in connection with the accompanying drawings, in which:

FIG. 18 is a diagram illustrating music title selection;

FIG. 19 is a diagram illustrating a relationship between automatic backing style, stage effect, and performance situation image;

DETAILED DESCRIPTION OF PREFERRED EMBODIMENTS

This invention will be described in further detail by way of example with reference to the accompanying drawings.

Figure 1:
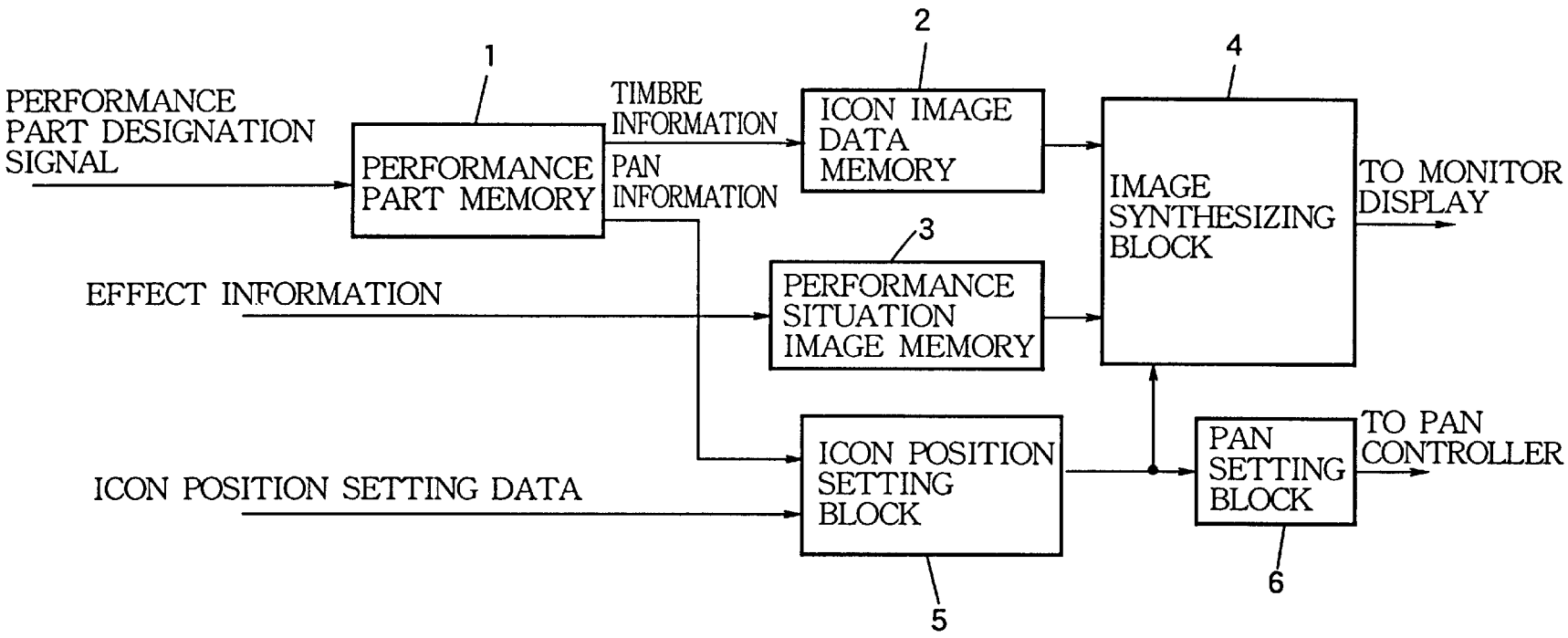
FIG. 1 is a functional block diagram illustrating an inventive music apparatus, the diagram describing a music system presenting method practiced as a first preferred embodiment of the invention.
Figure 2:
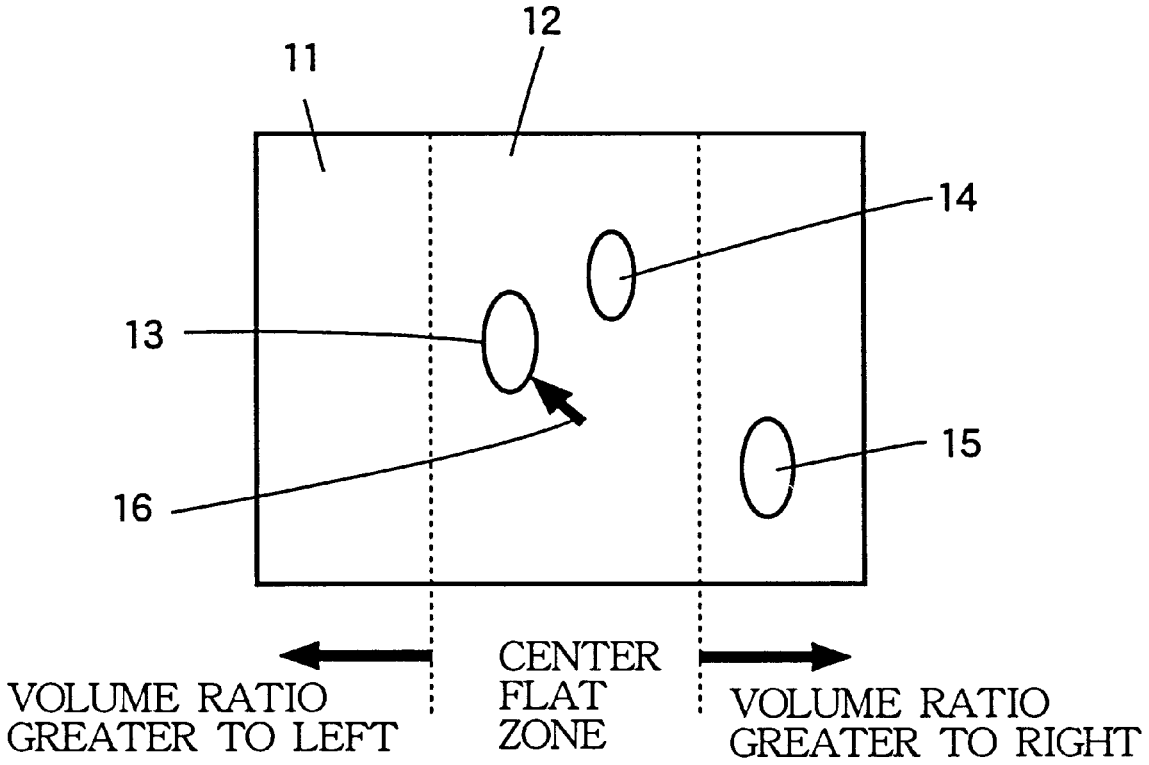
FIG. 2 is a diagram illustrating a monitor screen for describing the first preferred embodiment shown in FIG. 1.

Now, referring FIG. 1, in a first embodiment of the inventive music apparatus, reference numeral 1 denotes a performance part memory. Reference numeral 2 denotes an icon image data memory. Reference numeral 3 denotes a performance situation image data memory. Reference numeral 4 denotes an image data synthesizing block. Reference numeral 5 denotes an icon position setting block. Reference numeral 6 denotes a pan setting block. Referring to FIG. 2, an image 11 represents a performance situation and environment of a music system composed of performance parts. The image 11 contains a player icon 13, a player icon 14, and a player icon 15, corresponding to the respective performance parts, and a mouse cursor 16.

Referring to FIG. 1 again, the inventive apparatus is constructed to play the music system constituted by one or more performance parts. The performance part memory 1 stores timbre information indicative of a timbre of each performance part and pan information thereof. When the user specifies a performance part in the performance part memory 1, to read out the timbre information, the timbre of each performance part is identified or discriminated. Then, according to the timbre information, icon image information for the timbre of each part is read out from the icon image data memory 2. At the same time, according to acoustic effect information to be applied to the entire music system, image data representing a virtual scenery setting such as a situation and environment of the music system is retrieved from the performance situation image data memory 3. The image data synthesizing block 4 operates according to the icon image data of each performance part and the image data representing the scenery setting for creating a composite image in which the icons representing the performance parts are arranged in the image representing the virtual scenery setting, and outputs the created image onto a monitor display.

Namely, the inventive method is designed for displaying a visual image of a music system that is constructed to play at least one performance part with a particular timbre and that is acoustically characterized by a specific effect. The inventive method is carried out by the steps of analyzing data representative of the music system to discriminate the specific effect applied to the music system and to discriminate the particular timbre allotted to the performance part of the music system, providing a picture of a virtual setting in matching with the discriminated specific effect such that the picture of the virtual setting visualizes a situation and environment in which the music system should be played with the specific effect, providing an icon in correspondence with the discriminated particular timbre such that the icon symbolizes playing of the performance part with the allotted timbre, and arranging the icon of the performance part in the picture of the virtual setting to thereby synthesize the visual image of the music system.

The icons such as the player icon 13 shown in FIG. 2 are images concretely representing players playing musical instruments corresponding to the timbers of the performance parts. Each of these icons has the following capabilities in the music system. A first capability is to visually indicate the timbre and the operating state of each part. A second capability is to specify the performance part corresponding to an icon clicked with a mouse. A third capability is to visually indicate, according to the position of the icon, the sound image panning for the performance part corresponding to the icon in this music system.

An effect to be set to the music system is, in other words, an environment to be set to the music system. One specific example of the environment is the music genre of an automatic backing style or automatic accompaniment style. The automatic backing style specifies a musical instrument, a rhythm, a tempo, and so on for use in automatic backing. Automatic backing styles are stored as classified by music genre. Music genre includes dancing, classical, jazz, rock, folk, and so on, for example.

The image 11 represents the virtual scenery setting of the music system in a simulated manner such as a performance stage or a performance hall. The user can color and design the image 11 according to a music genre to be performed by the music system. For a classical music piece, for example, the user can use a scenery picture with shapes, colors, and textures of curtains and floors of the performance stage and props, all selected in matching with the image of the classical music piece.

Namely, the inventive method is designed for displaying a visual image of a music system that is constructed to play at least one performance part with a particular timbre and that is accompanied by a specific style of an accompaniment. The inventive method is carried out by the steps of analyzing data associated to the music system to discriminate the specific style applied to the music system and to discriminate the particular timbre allotted to the performance part of the music system, providing a picture of a virtual setting in matching with the discriminated specific style such that the picture of the virtual setting visualizes a situation and environment in which the music system should be played with the specific style, providing an icon in correspondence with the discriminated particular timbre such that the icon symbolizes playing of the performance part with the allotted timbre, and arranging the icon of the performance part in the picture of the virtual setting to thereby synthesize the visual image of the music system.

Another effect to be set to the music system includes stage effect such as reverberation. Reverberation types are classified into hall, room, and stage, for example. Each reverberation type is configured by to collective setting various parameters such as reverberation time, diffusion, and initial delay. According to these reverberation types, different pictures are provided for the scenery setting of the music system. For example, a picture reminding a hall is used for a hall image, a picture reminding a room is used for a room image, and a picture reminding a stage is used for a stage image. Alternatively, images of scenery settings having apparently different depths and widths may be prepared and, one of these images may be selected according to the reverberation time.

The following describes pan control over sounds of each performance part. Referring to FIG. 2, the lateral positions of the player icons 13, 14, and 15 relative to the left and right sides of the image 11 visually represent the sound lateral mage panning of the performance parts corresponding to these icons. As shown in FIG. 1, lateral pan information indicative of the sound image panning of each performance part is stored in the performance part memory 1. This lateral pan information is read out from the performance part memory 1 to identify the sound image panning of each performance part. The icon position setting block 5 controls the image data synthesizing block 4 to create an image with the icons laterally located according to the lateral pan information in the picture representing the scenery setting.

Namely, the inventive method is designed for displaying a visual image of a music system that is constructed to play at least one performance part with a particular timbre and a lateral pan. The inventive method is carried out by steps of analyzing data associated to the music system to discriminate the particular timbre allotted to the performance part of the music system and to discriminate the lateral pan applied to the performance part, providing an icon in correspondence with the discriminated particular timbre such that the icon symbolizes playing of the performance part with the allotted timbre, providing a picture of a virtual setting to visualize a situation and environment designed for the music system, and locating the icon of the performance part at a lateral position in the picture of the virtual setting in accordance with the discriminated lateral pan to thereby synthesize the visual image of the music system.

In the specific example shown in FIG. 2, the lateral positions of the icons such as the player icon 13 are determined according to the sound image panning position of each performance part in the virtual sound field of the music system. Consequently, pan control is visually displayed in which the sound of the performance part whose icon is located to the left is outputted louder from the left-side loudspeaker than the right-side loudspeaker and, conversely, the sound of the performance part whose icon is located to the right is outputted louder from the right-side loudspeaker than the left-side loudspeaker.

Conversely, the pan information can be inputted by the display position of each player icon in the visual image 11 of the music system. Referring to FIG. 1, the icon position setting block 5 controls the image data synthesizing block 4 based on the position setting data for each icon inputted by the user with an input device such as a keyboard or a mouse, moving each icon up or down or left or right to a new position. Then, according to the new position of each icon in the left and right directions, the pan setting block 6 outputs to the pan controller the pan information for controlling panning of each performance part in the virtual sound field of the music system. Thus, the sound image panning of each performance part may be visually represented and, at the same time, the pan information can be visually set. It should be noted that the pan information of each performance part in the performance part memory 1 may be updated by the pan information outputted from the pan setting block 6. In the MIDI standard, the pan information can be set in 128 levels. However, in setting the pan information by moving the icons, it need not be set in such a high resolution. It is appropriate to represent a lateral coordinate position with a resolution of about 16 levels.

Referring to FIG. 2, when the user moves the mouse pointer 16 to the player icon 13 and clicks the left button of the mouse, the player icon 13 is selected. If the user drags the icon 13, the position setting data of the player icon 13 is updated. Consequently, the player icon 13 moves along with the mouse pointer 16. When the user releases the left button of the mouse, the player icon 13 stops at that position, which is newly established. Thus, the new position setting data of the player icon 13 is fixed. It should be noted that, FIG. 1, do not show functional blocks for synthesizing the image data of the mouse pointer 16, inputting of the position setting data of the mouse pointer 16, and outputting of the position setting data of the player icon 13 by the mouse.

According to the updated position setting data of the player icon 13, the pan setting block 6 outputs the lateral pan information of the performance part corresponding to the player icon 13 even during the period in which this position setting data is being updated. Alternatively, the pan setting block 6 may output the pan information for the fixed position setting data when the position setting data of the player icon 13 has been fixed. Thus, setting the arrangement of the player icon 13 on the screen, to be more specific, setting the pan information by the lateral coordinate position allows the user to execute a setting operation visually and intuitively.

For a specific example of a method of arranging the player icons including the player icon 13 first onto the picture representing the scenery setting, the player icons are arranged to the initial positions by assigning timbres to the performance parts in the menu screen at the time of editing. Alternatively, at the time of editing, an area for an image object representing a backstage is shown besides the image 11. In this backstage area, two or more prepared player icons are displayed. These player icons are arranged one by one into the image 11 by operating the mouse.

There is a tendency that the sound image of a performance part is localized in a center portion. If each sound image panning position is simply proportionally related to an icon display position, icons come to be crowded in the center portion, making the screen display cluttered. This also causes a sense of imbalance, making the display awkward. To circumvent this problem, a center area 12 indicative of a center pan level is provided relatively wide, and then the pan information is displayed interns of an icon position.

More efficiently, when executing pan control by changing icon setting position, the center area 12 may provide an insensitive dead zone for the lateral pan control. Namely, for the center area 12, a relatively wide insensitive zone is allocated to the lateral coordinate on the screen. Therefore, the player icon 13 and the player icon 14 arranged in the center area having a predetermined span in the left and right directions of the screen are on the same flat pan level with respect to the sound image panning of the performance parts. If a player icon is moved to a position at which another player icon is already arranged, positional adjustment may be executed so that these player icons are not completely overlapped with each other.

If about ⅕ of the center portion of the lateral coordinate is allocated to the center pan level as the center area 12, the player icons are scattered comparatively. Obviously, this value depends on the number of performance parts and other factors. Therefore, the predetermined width may be altered by the number of performance parts. Alternatively, the area relative to the lateral coordinate on the screen may be divided into plural small zones. The player icons arranged in the same small zone have the same pan information value. Consequently, the display positions of the player icons are not overlapped with each other.

Namely, the inventive method is designed for displaying a visual image of a music system that is constructed to play at least one performance part with a particular timbre and a desired lateral pan. The inventive method is carried out by the steps of analyzing data representative of the music system to discriminate the particular timbre allotted to the performance part of the music system, providing an icon in correspondence with the discriminated particular timbre such that the icon symbolizes playing of the performance part with the allotted timbre, providing a picture of a virtual setting to visualize a situation and environment designed for the music system, the picture of the virtual setting being divided into a sensitive zone and an insensitive zone, locating the icon of the performance part at a desired lateral position in the picture of the virtual setting to thereby synthesize the visual image of the music system, determining the lateral pan of the performance part dependently on the lateral position of the icon when the icon is located within the sensitive zone of the picture, and otherwise determining a flat lateral pan of the performance part regardless of the lateral position of the icon when the icon is located within the insensitive zone of the picture.

Figure 3:
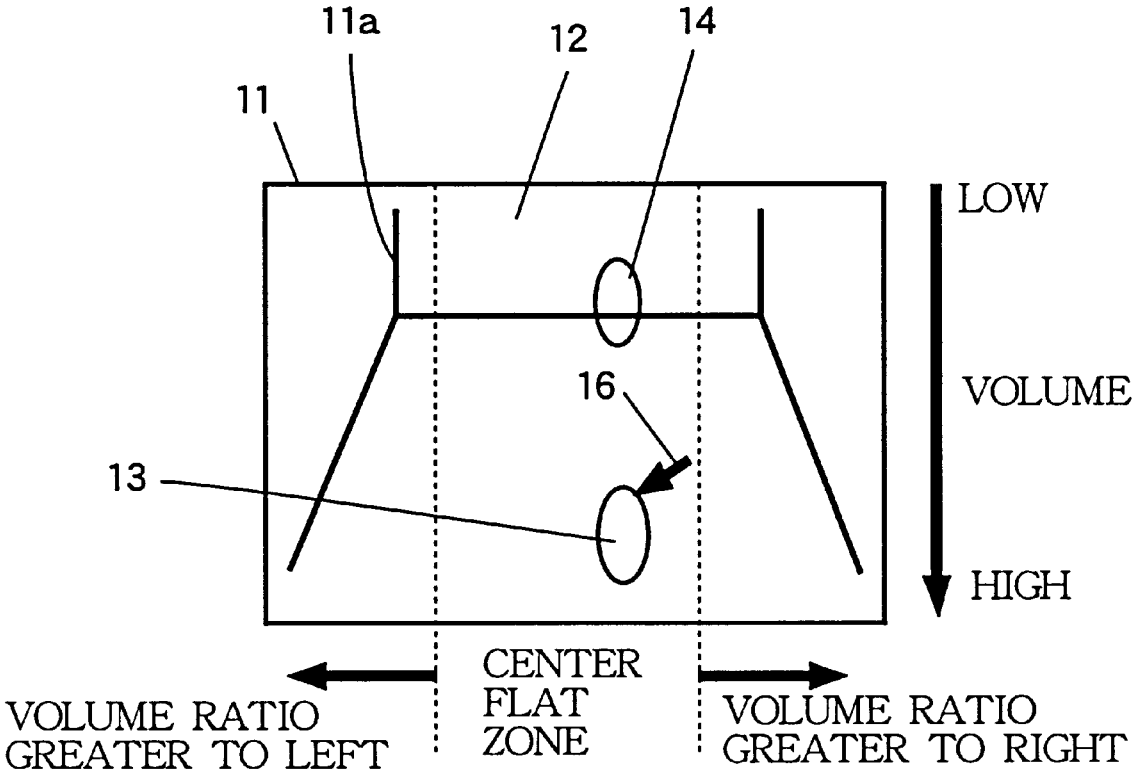
FIG. 3 Is a diagram illustrating a monitor screen for describing a variation to the first preferred embodiment shown in FIG. 1.

Now, with reference to FIG. 3 showing a variation, components similar to those previously described in FIG. 2 are denoted by the same reference numerals. Reference numeral 11*a* denotes a line drawing a performance stage. As seen from the line 11*a* and as compared with the screen display shown in FIG. 2, FIG. 3 shows a perspective scenery setting image. Consequently, the upper player icon 14 is shown as if it is back in the stage. Therefore, relating the vertical position or depth position of each icon to the sound volume of the corresponding performance part allows the user to intuitively grasp the on-stage arrangement of the performance parts.

To be more specific, referring to FIG. 1, the volume information indicative of the sound volume of each performance part is stored in the performance part memory 1. Reading the volume information, the icon position setting block 5 identifies the volume of each performance part, and sets the corresponding icon. Then, the icon position setting block 5 controls the image data synthesizing block 4 to create a scenery setting image with the icons vertically arranged according to the identified volume information. It should be noted that, instead of assigning the volume in the vertical or depth direction, a magnitude of an acoustic effect to be individually set for each performance part may be allocated to the depth direction.

Namely, the inventive method is designed for displaying a visual image of a music system that is constructed to play at least one performance part with a particular timbre and a sound volume. The inventive method is carried out by the steps of analyzing data representative of the music system to discriminate the particular timbre allotted to the performance part of the music system and to detect the sound volume set to the performance part, providing an icon in correspondence with the discriminated particular timbre such that the icon symbolizes playing of the performance part with the allotted timbre, providing a picture of a virtual setting to visualize a three-dimensional situation and environment having depth positions for accommodating the music system, and locating the icon of the performance part at a depth position in the picture of the virtual setting in accordance with the detected sound volume to thereby synthesize the visual image of the music system.

In FIG. 1, receiving the position setting data of each icon, the icon position setting block 5 controls the image data synthesizing block 4 to move the position of each icon to a new position. A volume setting block not shown is additionally provided. According to the new vertical position of each icon, the volume setting block outputs the volume information for controlling the sound volume of each performance part to a volume controller not shown. Further, the volume information outputted from the volume setting block may be used to update the volume information of each performance part stored in the performance part memory 1.

Referring to FIG. 3, the volume of the performance part represented by the player icon 13 is made smaller than that of the player icon 14 according to their vertical positions. The display positions of these icons may be moved by operating the mouse pointer 16. Namely, the picture of a virtual setting is provided to visualize a three-dimensional situation and environment having depth positions such that the icon can be located at a depth position in addition to the lateral position. Then, a sound volume of the performance part is determined dependently on the depth position of the icon located in the picture.

Figure 4:
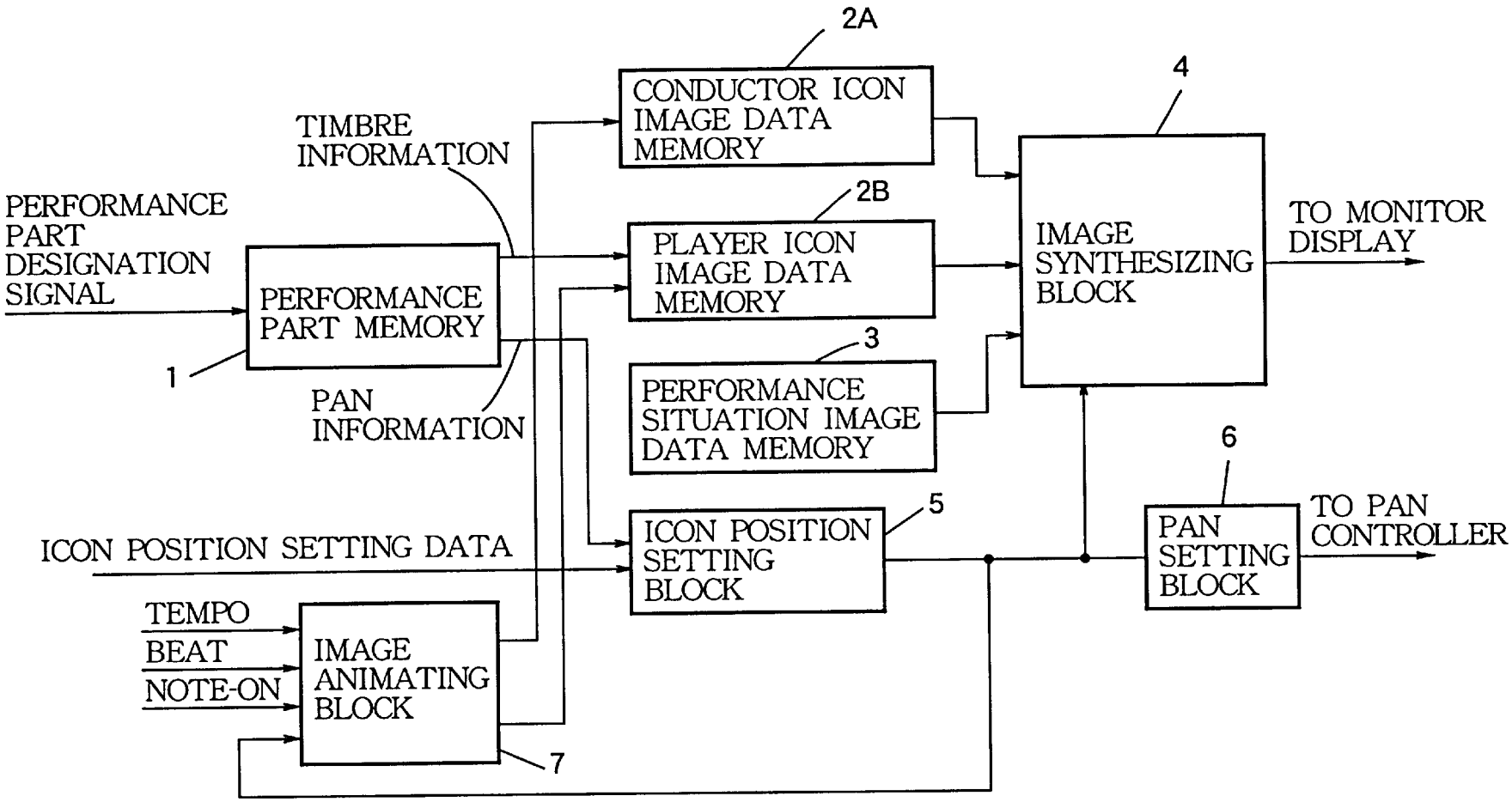
FIG. 4 is a functional block diagram illustrating another inventive music apparatus, the diagram describing a music system presenting method practiced as a second preferred embodiment of the invention.

Now, FIG. 4 shows a second embodiment of the inventive music apparatus. In the figure, reference numeral 1 denotes a performance part memory, reference numeral 2A a conductor icon image data memory, reference numeral 2B a player icon image data memory, reference numeral 3 a performance situation image data memory, reference numeral 4 an image data synthesizing block, reference numeral 5 an icon position setting block, reference numeral 6 a pan setting block, and reference numeral 7 an image animating block.

Figure 5:
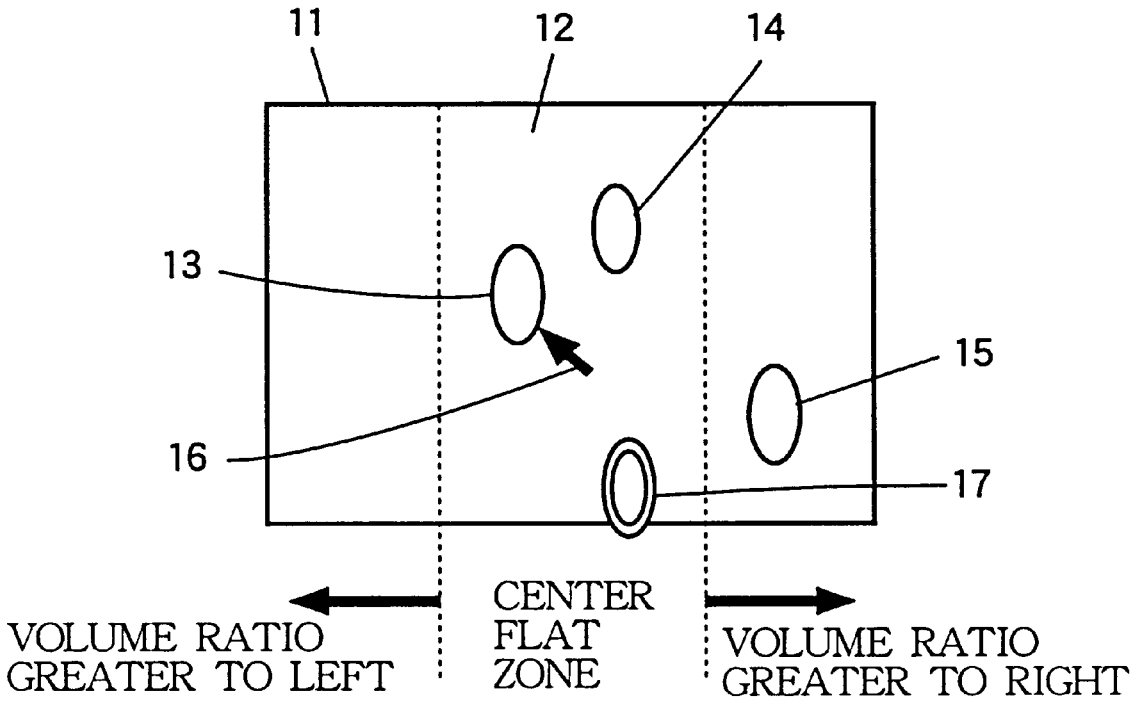
FIG. 5 is a diagram illustrating a monitor screen for describing the second preferred embodiment shown in FIG. 4.

Referring to FIG. 5, an image 11 representing a scenery setting of the music system contains a player icon 13, a player icon 14, a player icon 15, a mouse pointer 16, and a conductor icon 17.

Figure 6:
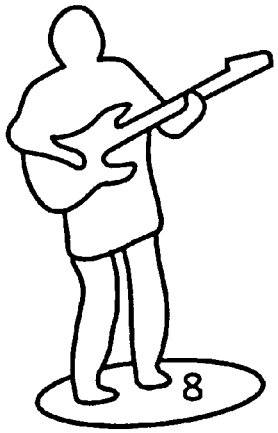
FIGS. 6(*a*) and 6(*b*) are diagrams illustrating a specific example of a player icon.
Figure 6:
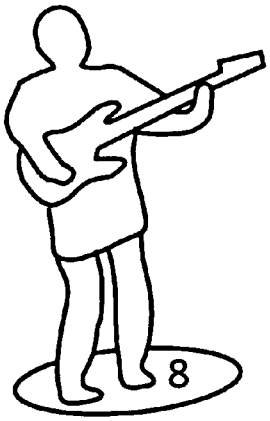

FIGS. 6(*a*) and (*b*) illustrate an example of a specific player icon representing a player playing the electric guitar. These images are created by taking two frames from a sequence of motions of a playing guitarist. In these figures, the images are shown in outline. Obviously, these images may also be shown two- or three-dimensional manner. It should be noted that a corresponding performance part number is shown in the spotlight portion of each image.

Figure 7:
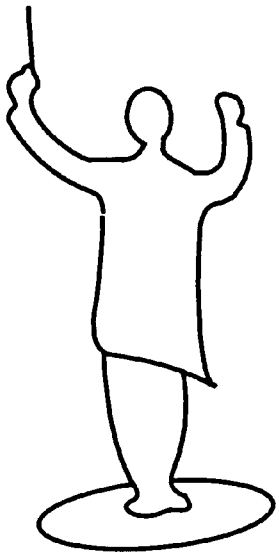
FIGS. 7(*a*) through 7(*c*) are diagrams illustrating a specific example of a conductor icon.
Figure 7:
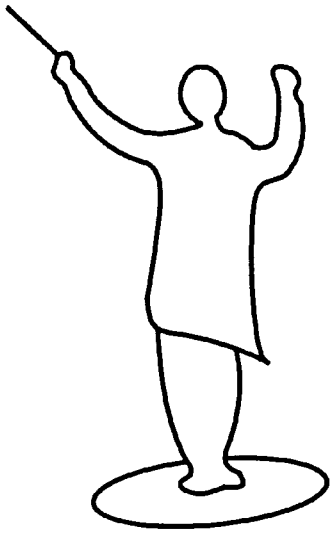
Figure 7:
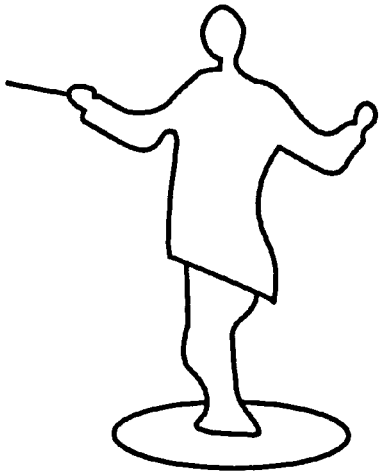

Referring to FIGS. 7(*a*), 7(*b*), and 7(*c*), images are illustrated representing a conductor in a conducting state. These images are created by taking three frames from a sequence of motions of a conductor. In these figures, the images are shown in outline. Obviously, these images may also be drawn in two- or three-dimensional manner.

An described before, the music system is constructed by one or more performance parts. The performance part memory 1 stores timbre information indicative of the timbre of each performance part and pan information thereof. When the user specifies a performance part to read out the timbre information of the specified performance part from the performance part memory 1, the timbre of each performance part is identified. Then, conductor icon image data is read out from the conductor image data memory 2A, and player icon image data corresponding to the timbre of each performance part is read out from the icon image data memory 2B according to the timbre information. At the same time, image data representing a virtual scenery setting of the music system is read out from the performance situation image data memory 3. According to these conductor icon image data, player icon image data of each performance part, and performance situation image data, the image data synthesizing block 4 creates a composite image with a conductor icon and player icons arranged in an image representing a scenery setting.

As illustrated in FIGS. 6(*a*) and 6(*b*), the icons such as the player icon 13 are images concretely representing players playing musical instruments corresponding to the timbers of the performance parts. Each of these icons has the following capabilities in the music system. A first capability is to display the timbre and the operating state of each part. A second capability is to specify the performance part corresponding to an icon clicked by a mouse. A third capability is to display, according to the position of this icon, the sound image panning for the performance part corresponding to the icon in this music system.

The conductor icon 17 shown in FIG. 5 has, in the processing of the music system, a first capability of displaying tempo and beat, and a second capability of specifying the tempo and beat by clicking the icon. The conductor icon 17 is not subjected to the pan control, so that this icon may be displayed out of the scenery setting image 11.

The following describes the pan control of the timbre of each performance part. Referring to FIG. 5, the positions of the player icons 13, 14, and 15 relative to the left and right sides in the image 11 visually represent the sound image panning of the performance parts corresponding to these icons.

As shown in FIG. 4, pan information indicative of the sound image panning of each performance part is stored in the performance part memory 1. This pan information is read out from the performance part memory 1 to identify the sound image panning of each performance part. The icon position setting block 5 controls the image data synthesizing block 4 to create an image with the icons located according to the pan information in the image representing the scenery setting of the music system.

In the specific example shown in FIG. 5, the lateral positions of the icons such as the player icon 13 are determined according to the sound image panning of each performance part in the virtual sound field of the music system. Consequently, the pan control is visually displayed such that the sound of the performance part whose icon is located to the left is outputted louder from the left-side loudspeaker than the right-side loudspeaker and, conversely, the sound of the performance part whose icon is located to the right is outputted louder from the right-side loudspeaker than the left-side loudspeaker.

Conversely, the pan information can be set by the display position of each player icon in the image 11. Referring to FIG. 4, the icon position setting block 5 controls the image data synthesizing block 4 based on the position setting data for each icon inputted by the user with an input device such as a keyboard or a mouse, moving each icon up or down or left or right to a new position. Then, according to the new position of each icon in the left and right directions, the pan setting block 6 outputs to the pan controller the pan information for controlling lateral panning of each performance part in the virtual sound field of the music system. Thus, the sound image panning of each performance part may be visually represented and, at the same time, the pan information can be visually set. It should be noted that the pan information of each performance part in the performance part memory 1 may be updated by the pan information outputted from the pan setting block 6.

There is a tendency that the sound image of a performance part is localized in a center portion. If a sound image panning position is simply proportionally related with an icon display position, icons come to be crowded in the center portion, making the screen display cluttered. This also causes a sense of imbalance, making the display awkward. To circumvent this problem, a center area 12 indicative of a center pan level is provided relatively wide, and then the pan information is displayed at an icon position. Conversely, when executing the pan control by changing the icon setting position, the center area 12 provides the center dead zone for the pan control.

The following describes the animation display of the player icons and the conductor icon in the second embodiment. Referring to FIG. 4, the image animating block 7 receives a tempo signal, a beat signal, and a note-on signal of the sound of each performance part to identify the tempo and beat of the sound, and to identify a sound generating duration of each note, thereby executing control for switching images to be read out from the conductor icon image data memory 2A and the player icon image data memory 2B. These memories each store two or more still pictures for representing a sequence of motions of the players and the conductor in performance.

During a sound generating duration of each performance part, the image animating block 7 reads out images representing the player icon of the performance part such as shown in FIGS. 6(*a*) and 6(*b*) from the player icon image data memory 2B in synchronization with the tempo, and sequentially changes these images to animate the player icon. The sound generating period of each performance part is started by detecting a sound generating command (equivalent to a "note-on" message in MIDI information) of each performance part.

Namely, the inventive method is designed for displaying a visual image of playing at least one performance part with a particular timbre in a music system. The inventive method is carried out by the steps of analyzing data representative of the music system to discriminate the particular timbre allotted to the performance part of the music system, synthesizing a picture containing an icon designed in correspondence with the discriminated particular timbre, generating a sound having the particular timbre according to the data of the music system to thereby play the performance part of the music system, and animating the icon in matching with the sound so that the icon visualizes the playing of the performance part with the allotted timbre.

The end of the sound generating period of each performance part is detected in several manners. First, the point of time at which the sound of each performance part goes off is detected. To be more specific, the point of time at which the envelope of the sound becomes zero or lower than a predetermined threshold is detected. Second, the sound generating state of each performance part coming to be detected over a predetermined period of time is detected.

In either detecting method, if another sound generating command comes during the current sound generating period, the player icon images representing a sequence of motions may be returned to the first one. This allows the motion of a player icon to start from the beginning every time a performance part sound generating command comes. In addition, it is specified that only one sound generating command is not allowed to repetitively use the same player icon image. Consequently, even in the case of musical instruments such as guitar that are visually conspicuous in the difference between playing forms, at start of sound generation and during subsequent sound generating period, the motion of the player icon is saved from becoming awkward.

Further, if the motion of a player icon is made large or small according to the level of a sound during the sound generating period, namely according to the magnitude of a sound envelope, the visual display of the icon becomes more effective. To do so, two or more images having different forms in each process of a sequence of motions are stored in the player icon image data memory 2B. The stored images representing a particular player icon are then read out from the memory according to the tempo and sound level of the performance part to sequentially changing the images, thereby imparting a motion responsive to the sound level to the player icon.

Music data of the music system contains plural performance parts. When "mute" is specified for a performance part by operating the mouse in a track view window, a sound generating command for any performance part assigned to this track is ignored, not starting a sound generating operation. This prevents the player icon of the muted performance part from being animated. When "solo performance" is specified for a performance part, a sound generating command for any performance part other than that assigned to the solo track is ignored, not starting a sound generating operation. This allows only the player icon allotted with the solo performance to be animated, thereby visually representing the motion of each performance part.

While imparting motions to the player icons, frames of the conductor icon shown in FIGS. 7(*a*), 7(*b*), and 7(*c*) are sequentially retrieved from the conductor icon image data memory 2A according to the tempo and beat of a particular performance part during the automatic performance of one piece of music during both of the note-on and note-off periods of each performance part, thereby animating the conductor icon by sequentially changing the frames of the conductor icon. The number of conductor icon frames for use in animating the conductor icon is determined according to the tempo of the performance part. For example, if the performance part is of two beats, the number of motion frames is two and therefore two different images are cyclically read out and changed over for animation. If the performance part is of three beats, the number of motion frames is three and a sequence of images matching the beat is cyclically read out and changed over for animation. Namely, the conductor icon frames are sequentially changed over with a tempo-matched interval and the same frames are repeated in response to the beat.

Namely, the inventive method is designed for displaying a visual image of playing a music system containing at least one performance part having a particular timbre. The inventive method is carried out by the steps of analyzing data representative of the music system to discriminate the particular timbre allotted to the performance part of the music system, synthesizing a picture containing a player icon corresponding to the discriminated particular timbre and symbolizing the performance part of the music system, and a conductor icon symbolizing a conductor of the music system, generating a sound according to the data of the music system to thereby play the music system, and animating the conductor icon in matching with the sound so as to visualize the playing of the music system.

In the above-mentioned embodiment, the conductor icon is constantly animated during a performance period. In another example, the conductor icon may be animated only in a performance period and when any one of performance parts is in a sound generating state.

It would enhance the visual representation still further if the conductor icon is directed toward active player icons of the sound generating performance parts. To realize this, two or more sets of images of conducting motions according to beats with the orientations of the conductor icon changed are stored in the conductor icon image data memory 2A. The positions of the player icon and the conductor icon of a sound generating performance part are retrieved from the icon position setting block 5. Based on the relative relationship between these positions, an angle from the conductor icon position to the position of the player icon of the sound generating performance part is calculated to select the conductor icon image directed to the player icon.

If two or more performance parts are generating sounds, the conductor icon may be directed to the center between these performance parts. While no performance part is generating a sound, the conductor icon may be left unchanged in direction and stopped in motion, or may be returned toward audience. At start and end of performance, the conductor icon is adapted to face audience.

In the above-mentioned examples, the player icon and conductor icon images are stored in the image data memories as plural still images representing sequences of motions. These stored images are read as required and sequentially changed over, thereby imparting a sequence of motions to each icon. Decreasing the number of these still images accordingly decreases the size of the image data to be stored and lessens the processing overhead of image switching. Conversely, increasing the number of still images, 30 frames per second for example, and decreasing the image switching interval smoothes icon motions for enhanced display quality. If there are only small number of basic still images, the icon motions may be smoothed by interpolating the still image data to create an intermediate still image with these still images used as key frames. This technology is known as an animation creating technology in the field of three-dimensional computer graphics, for example.

Now, with reference to FIG. 8, a sample music data setting apparatus practiced as a third preferred embodiment of the invention will be described. In the figure, reference numeral 1 denotes a performance part memory, reference numeral 2 an icon image memory, reference numeral 3 a performance situation image memory, reference numeral 4 an image data synthesizing block, reference numeral 5 an icon position setting block, reference numeral 6 a pan setting block, reference numeral 8 a melody/backing decision block, and reference numeral 9 a sample music data memory.

In the third preferred embodiment, a music system is constructed by one or more performance parts. The performance part memory 1 stores the timbre information indicative of the timbre of each performance part and the pan information thereof. When the user specifies a performance part to read out the timbre information thereof from the performance part memory 1, the timbre of that performance part is identified. Then, the user specifies the music genre of the music data for auditioning and the tempo of the music to be performed. According to the combinations of the identified timbre, the specified music genre and the music tempo, and further the type of the performance part outputted from the melody/backing decision block 8, sample music data suited to the specified condition is read out from the sample music data memory 9 and outputted along with the timbre information to a tone generator block not shown.

In addition to the information about individual notes and timbre, the sample music data includes duration information for indicating the time interval of a sound generation event, for example. The sample music data is sequence data having a file format that is convertible into sound waveform data in the tone generator block. A specific example is a standard MIDI file (SMF). This sample music data constitutes a piece of music that is coherent to a certain degree. A specific example is one or more bars of phrase data. The whole piece of music may also be used for the sample music data. It should be noted that the sample music data may be a wave format file. In this case, only a D/A converting capability for converting digital waveform data into an analog waveform may be provided. However, the size of waveform data to be stored significantly increases.

Distinction between a melody part and a backing part is determined by the position of the icon of each performance part as will be described with reference to FIG. 10. According to the timbre information, the icon image information for the timbre of each performance part is read out from the icon image data memory 2 and, at the same time, the image data indicative of a virtual scenery setting of the music system is read out from the performance situation image data memory 3. According to the icon image data and the performance situation image data retrieved from the corresponding memories, the image synthesizing block 4 creates a composite image with the icons representing the timbres of the performance parts arranged in the image representing the scenery setting, and outputs the created composite image to a display monitor block not shown.

Figures 9, 10:
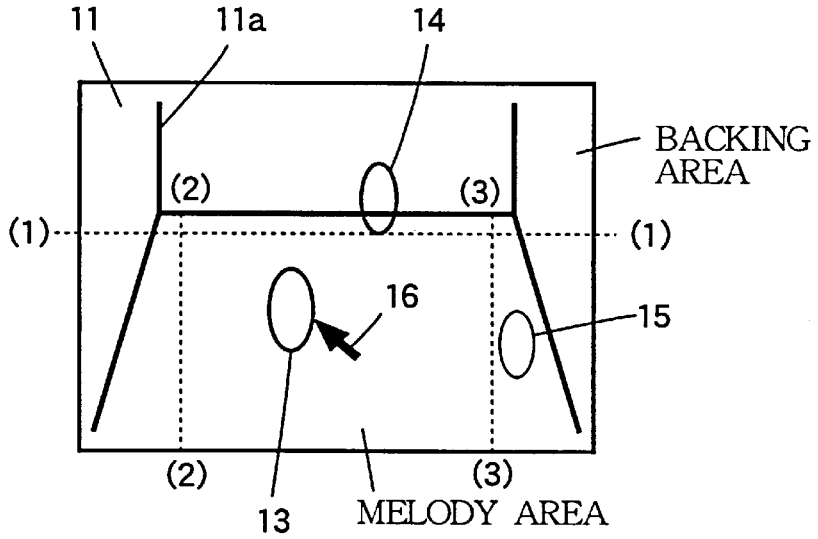
FIG. 9 is a diagram illustrating a list of sample music data according to the invention.
FIG. 10 is a diagram illustrating the sample music data setting method according to the invention.

Referring to FIG. 9, there is shown a relationship between selection conditions and sample music data for a certain timbre. The sample music data memory 9 stores music data for each different timbre. The music data is further classified by music genre. The music data is also classified by tempo. The music data is available for melody and for backing, separately from each other. By various combinations of the music genre, tempo, and category as to melody part or backing part, the stored sample music data is determined and retrieved.

By assuming a music for which a particular timbre is used, the music data of numbers suitable for auditioning the timbre is prepared. The sample music data is selected according to the timbre. In timbre selection, this sample music data is performed for easy evaluation of the timbre, thereby enhancing the quality and efficiency of timbre selection. In addition, performing the sample music data allows the user to confirm the created orchestration data with reality.

Further, not only by selecting the music data by timbre attributes but also by changing sample music data on conditions such as music genre, tempo, and category as to melody or backing, the timbre selection becomes more suited to the user environment, and the timbre characteristics become easier to comprehend. It should be noted that preparation of different sample music data for each timbre vainly increases the amount of the data, deteriorating the cost-performance. Therefore, it is better to prepare the sample music data for each category of timbres.

While preparing the sample music data for each category of timbres, the player icons are made represent timbres classified by category in order not to increase the number of player icons to be displayed. It is also practicable to specify particular timbres from categories by use of a menu screen and to determine the sample music data according to the specified timbres. To cite a particular example, there is a method of timbre selection in which a bank is specified and one of the timbres in that bank is specified. The timbers in the bank are associated to player icons. Then, when setting the sample music data, the same is selected according to each timbre in the bank. Further, the sample music data may be changed by the above-mentioned various conditions.

Now, referring to FIG. 10, components similar to those previously described with the first preferred embodiment shown in FIG. 2 are denoted by the same reference numerals. An image 11 is three-dimensionally drawn as indicated by a line 11*a* representing a stage. Consequently, a player icon 14 located in the upper portion of the screen looks placed back in the stage. The area of the screen above the boundary indicated by dashed line (1)—(1) defines a backing area. The performance parts corresponding to the icons arranged in the backing area are set for backing. On the contrary, the area below this boundary defines a melody area. The performance parts corresponding to a player icon 13 and a player icon 15 are set for melody.

Figure 8:
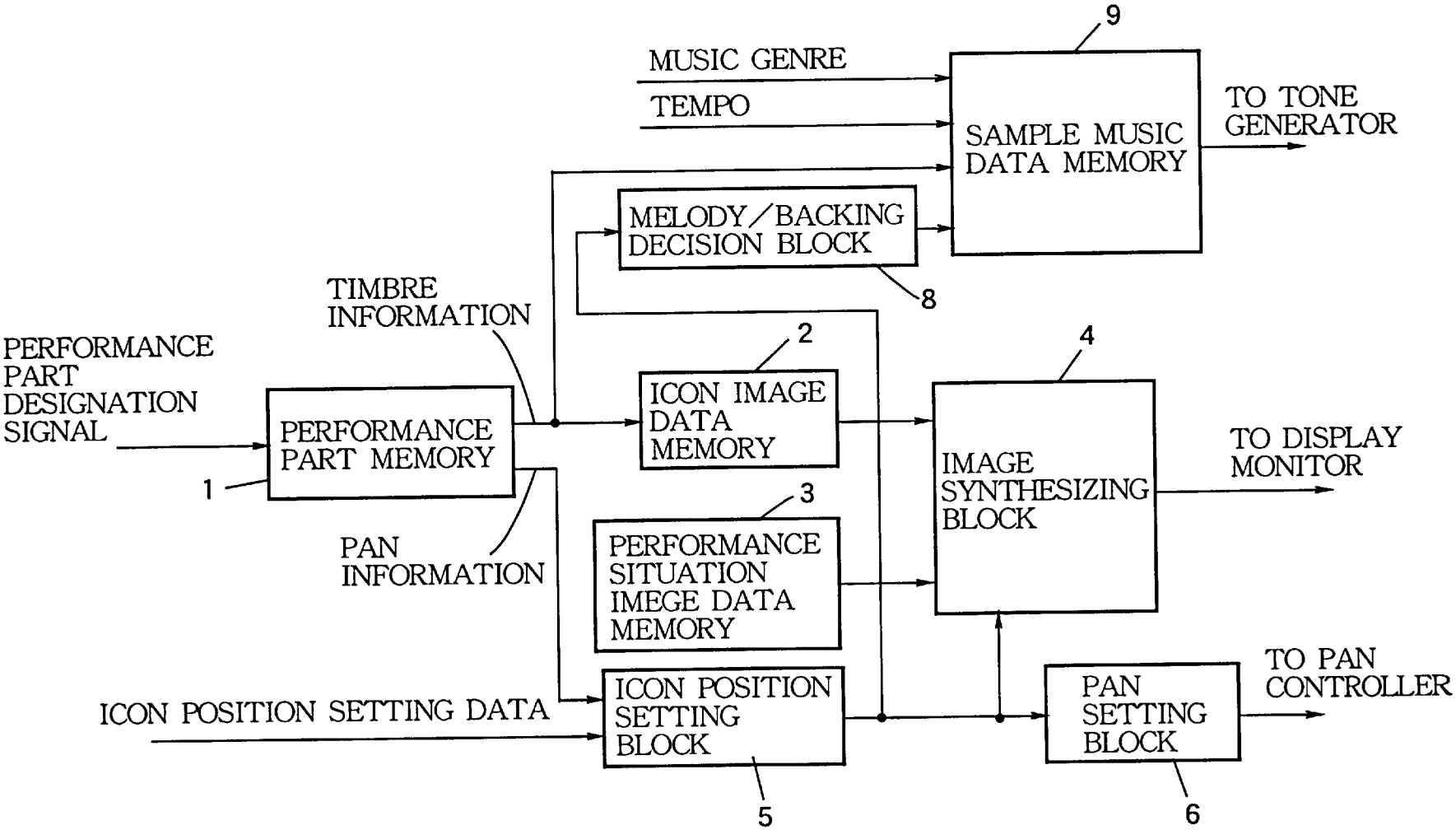
FIG. 8 is a functional block diagram illustrating a further inventive music apparatus, the diagram describing a third preferred embodiment of the invention.

Referring to FIG. 8, the position setting data of the icon of each performance part is inputted in the icon position setting block 5 to set the position of the icon in the scenery setting image. According to the icon position thus set, the melody/backing decision block 8 decides whether the performance part is for melody or backing, storing the setting condition as to the melody or backing into the sample music data memory 9.

Namely, the inventive method is designed for determining a sample of music data for use in auditioning performance parts of a music system. The inventive method is carried out by the steps of analyzing data representative of the music system to discriminate timbres allotted to the performance parts constituting the music system, providing icons in correspondence with the discriminated timbres such that the icons symbolize playing of the performance parts with the allotted timbres, providing a picture of a virtual setting to visualize a situation and environment of the music system, the picture containing a melody area and a backing area, arranging a location of each icon of each performance part in either of the melody area and the backing area on the picture of the virtual setting to thereby synthesize a visual image of the music system, some performance part being allocated to the melody area for playing a melody while other performance part being allocated to the backing area for backing the melody, and selecting one of the icons arranged in the visual image of the music system so as to determine a sample of music data for use in auditioning the performance part of the selected icon, according to the timbre allotted to the performance part of the selected icon and according to the location of the selected icon as to the melody area and the backing area.

Another method of setting the icon display area is also available, in which the area inside the boundaries indicated by dashed lines (1)—(1), (2)—(2), and (3) defines the melody area and the area outside these boundaries defines the backing area. In this case, only the performance part corresponding to the player icon 13 is set for playing the melody. Alternatively, a melody area enclosed by a circle or an ellipse may be set in the center zone and a backing area outside the center zone.

For the above-mentioned sample music data, the music data preset in the memory is used. It is also practicable that the user retrieves sequence data of the performance part using that timbre from a music piece newly created by the user, or the sequence data is automatically extracted to be stored in the sample music data memory 9.

There are several methods of retrieving sample music data from the sequence data of a corresponding performance part. Simplest is use of the first portion of the sequence data. In another method, a portion having higher data density of the MIDI data of the performance part having a specified timbre is used as sample music data to increase the probability of using the climax of the music. Obviously, the user can specify any desired interval of the MIDI data and can use it as sample music data.

When the sample music data is automatically extracted from the sequence data such as MIDI data, the first portion of the sequence data often includes timber edit data. Therefore, the beginning of the sequence data may be considered edit data, and it is assumed that the data up to a point at which note-on data first appears be edit data, the data after that point being performance data, from which sample music data may be extracted.

It is not preferable for the sample music data to be too lengthy. Therefore, when automatically extracting the sample music data, it is preferable to set the upper limit of extraction time. When creating the sample music data to be preset in the memory, necessary data may be retrieved and preset in a manner generally similar to that mentioned above.

Figure 11:
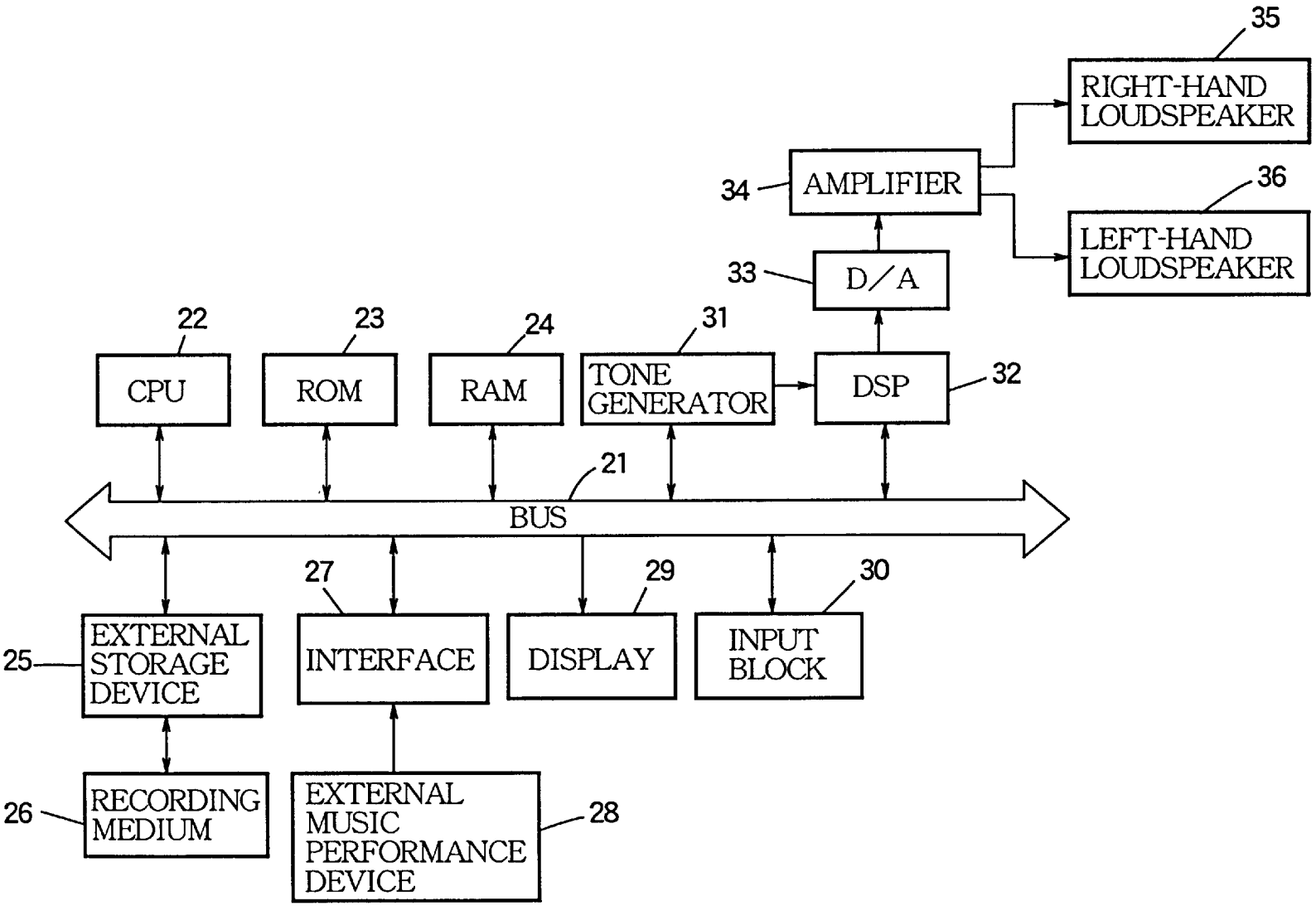
FIG. 11 is a block diagram illustrating a hardware configuration of the music apparatus practiced as one preferred embodiment of the invention.

Referring to FIG. 11, there is shown a hardware configuration of a personal computer in which a sequencer or a sound board are built in. The functional block configurations of the embodiments shown in FIGS. 1, 4 and 8 are implemented by executing the operating system and application software on this hardware.

In FIG. 11, a bus 21 is connected to a CPU (Central Processing Unit) 22, a ROM (Read Only Memory) 23, a RAM (Random Access Memory) 24, an external storage device 25, an interface 27, a monitor display 29, an input block 30, and a tone generator block 31. The external storage device 25 consists of one or more of an FDD (Floppy Disk Drive), an HDD (Hard Disk Drive), and CD-ROM (Compact Disc ROM) drive, into which a compatible recording medium 26 is loaded. The interface 27 is connected to an external music performance device 28 such as a MIDI keyboard. The music output from the tone generator block 31 is supplied to a DSP (Digital Signal Processor) 32. The processed signal is converted by a D/A (Digital to Analog) converter 33. The converted signal is amplified by an amplifier 34 of stereo two-channel type. The amplified signal is sounded by a right-hand loudspeaker 35 and a left-hand loudspeaker 36.

The operating system software and the sequence software are stored in the hard disk and the recording medium (computer readable medium) 26. The CPU 22 loads necessary programs and data from the ROM 23 and the hard disk into the RAM 24 to execute various processing operations. The sequence software is distributed as recorded on a CD-ROM which is one type of the computer readable medium 26, and installed on the hard disk for execution. The invention covers the computer readable medium 26 for use in the personal computer shown in FIG. 11 having the CPU 22. The medium 26 contains the sequence software in the form of program instructions executable by the CPU 22 for causing the computer to carry out the various inventive methods as described before. Alternatively, the sequence software is downloaded from an external server onto the hard disk through a communication interface not shown.

The CPU 22 executes, as a sequence capability, real time recording based on the information supplied from the external music performance device 28. The CPU 22 displays a staff window or a piano role window for example onto the monitor display 29 constituted by a LCD (Liquid Crystal Display) or a CRT (Cathode Ray Tube) to execute step-recording by use of the input block 30 such as a keyboard or a mouse. The CPU 22 loads a music data file from the recording medium 26 into the RAM 24 for reproduction of a music piece.

The tone generator block 31 can simultaneously sound two or more performance parts. The tone generator block 31 generates a sound having a timbre assigned to each performance part, and outputs the generated sound to the DSP 32. The DSP 32 imparts an acoustic effect such as reverberation or chorus to the sound. In order to execute sound image panning in a virtual sound field, the DSP 32 sets the volume ratios between the left and right loudspeakers based on the pan Information of each performance part, and outputs the volume ratio to the A/D converter 33. The A/D-converted sound signal is outputted to the stereo amplifier 34. The amplified signal is then sounded from the right loudspeaker 35 and the left loudspeaker 36. Thus, the tone generator block 31, DSP 32 and so on constitute a sound source for playing the music system composed of the performance parts.

The CPU 22 also displays, at the sound generation, virtual positions of two or more sound sources, thereby visually representing the music system. The stages subsequent to the amplifier 34 may be regarded as external devices. In some cases, the tone generator block 31 and the DSP 32 are replaced by external tone generator devices in which MIDI data is outputted to these devices through a MIDI interface not shown. Sometimes, a MIDI keyboard is provided on the input block 30. If no hard disk drive is provided, the software may be installed in the ROM 23.

The above-mentioned embodiment is supported by a personal computer with DTM program such as sequence software installed in the recording medium 26 of the external storage device 25. It will be apparent that a DTM apparatus may also support the inventive method. At least a portion of the programs may be provided in hardware logic.

Figure 12:
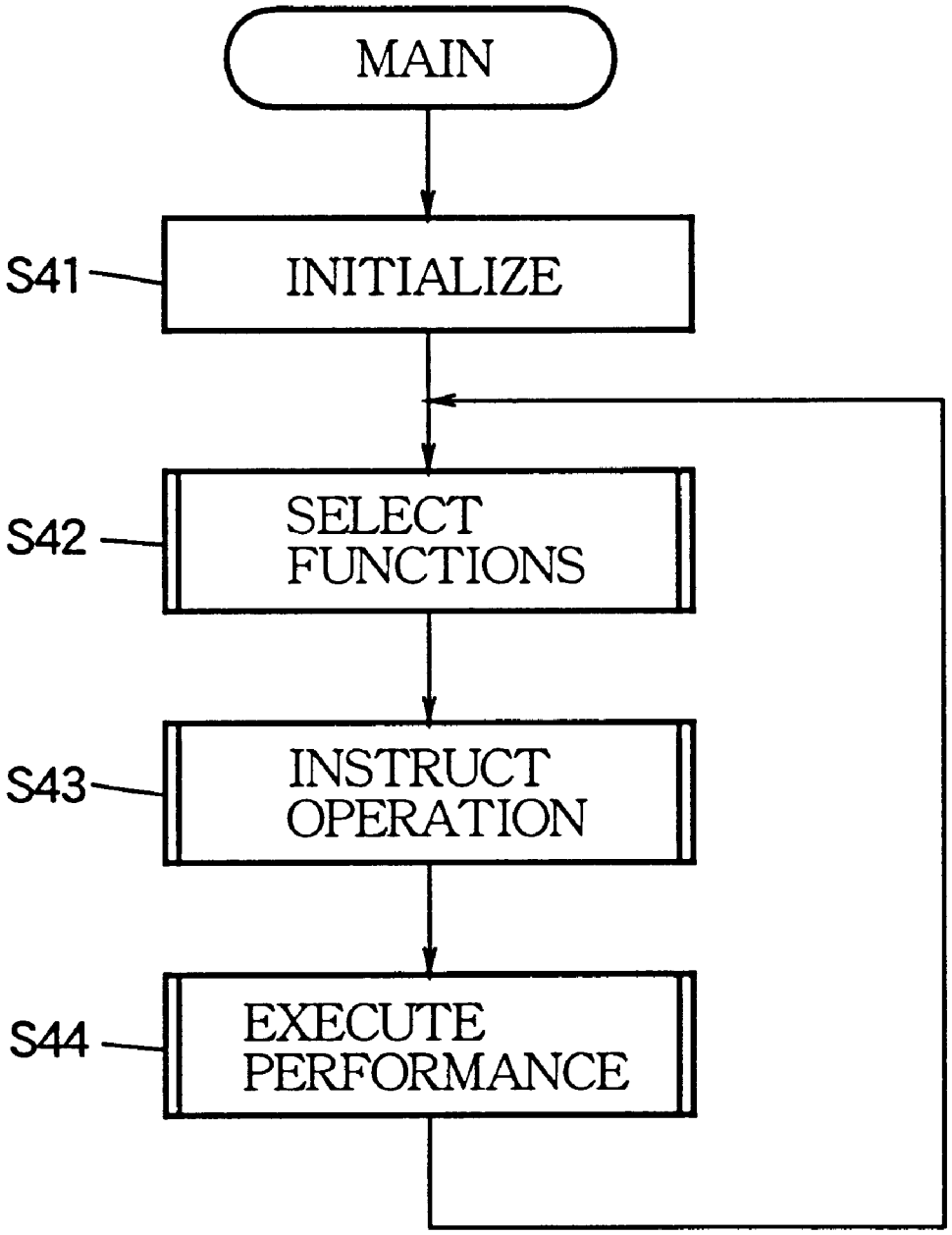
FIG. 12 is a main flowchart describing the embodiment shown in FIG. 11.
Figure 13:
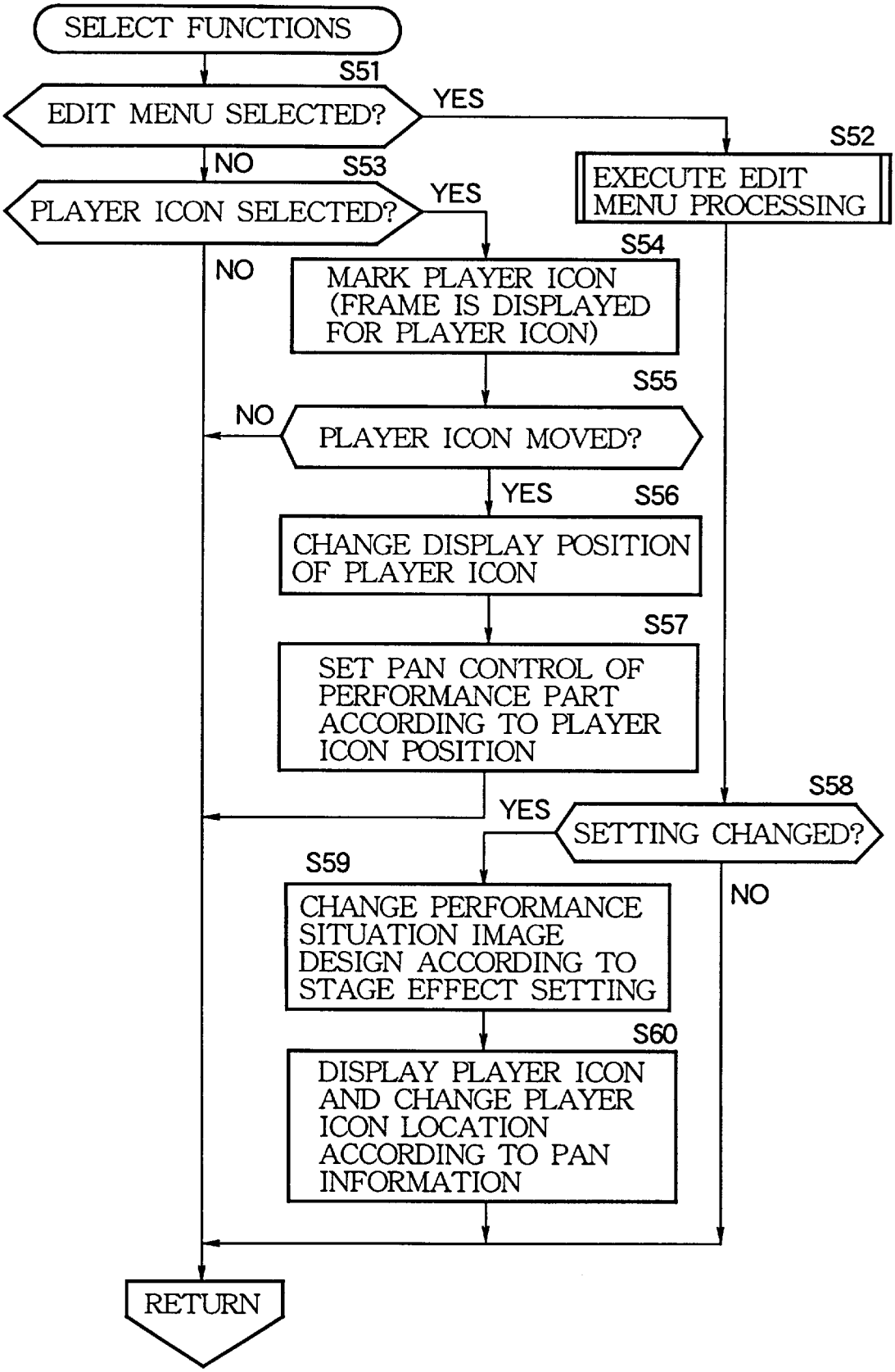
FIG. 13 is a flowchart for a function select step shown in FIG. 12.
Figure 14:
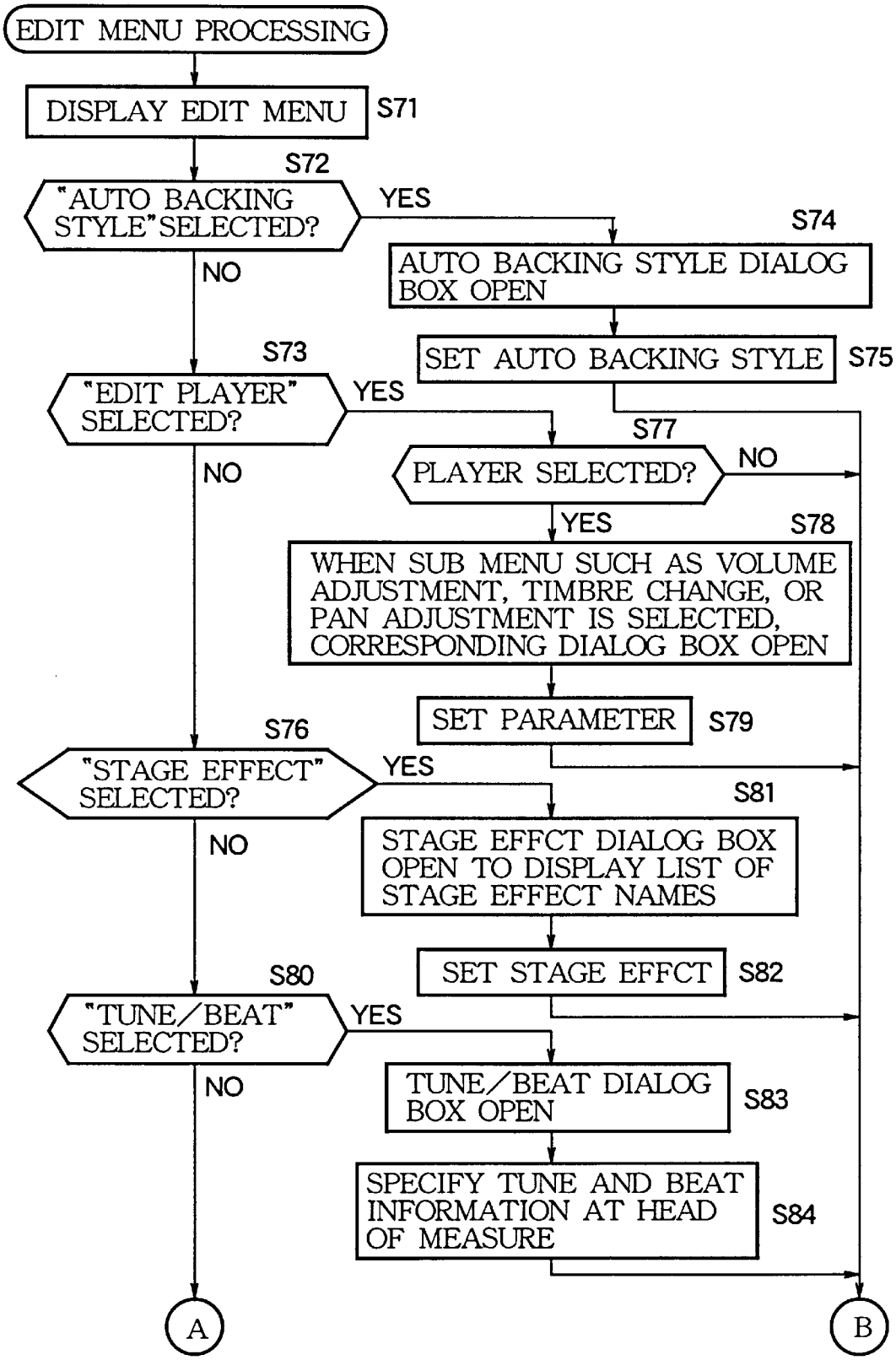
FIG. 14 is a first flowchart for an edit menu processing step shown in FIG. 13.
Figure 15:
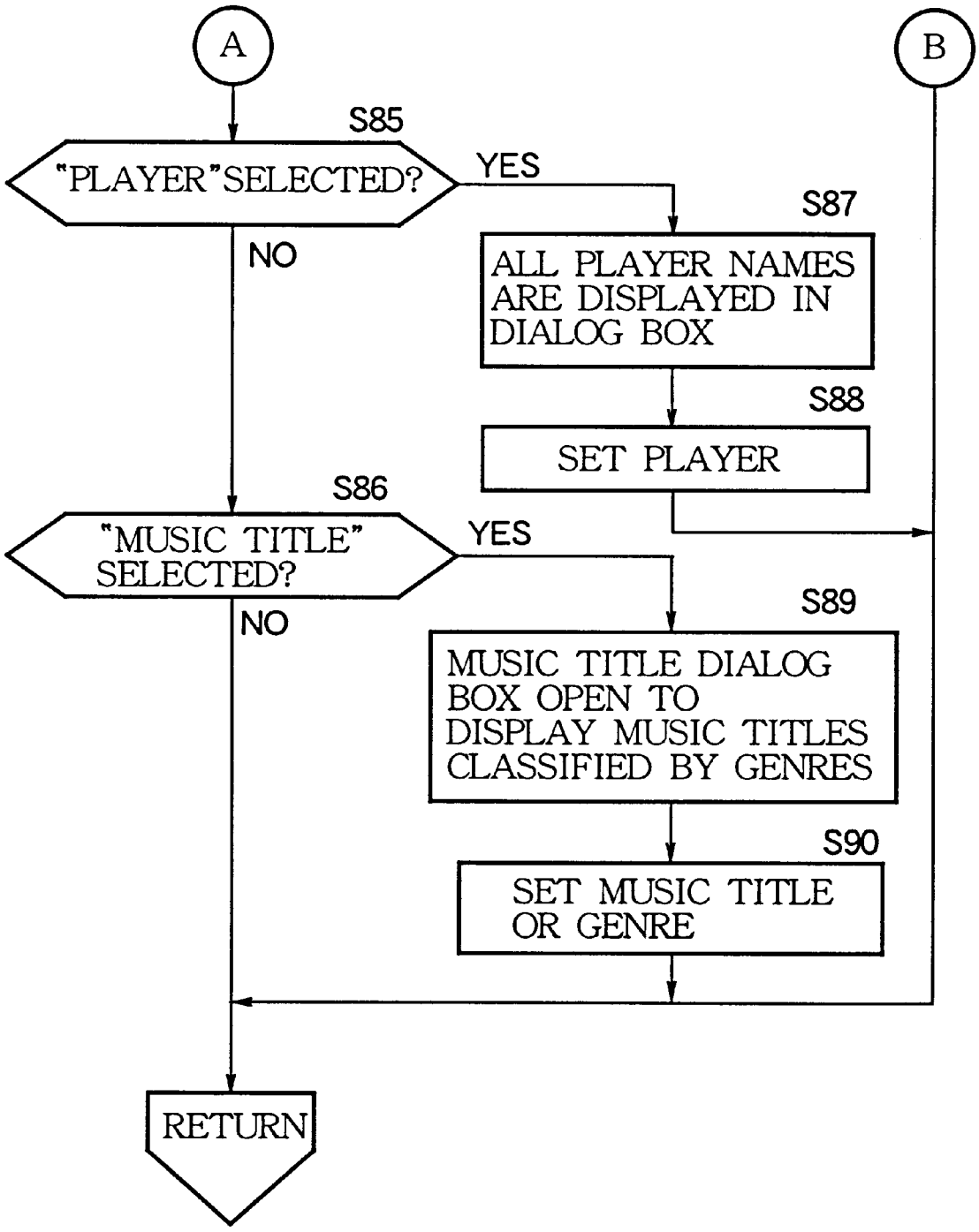
FIG. 15 is a second flowchart for an edit menu processing step shown in FIG. 13.
Figure 16:
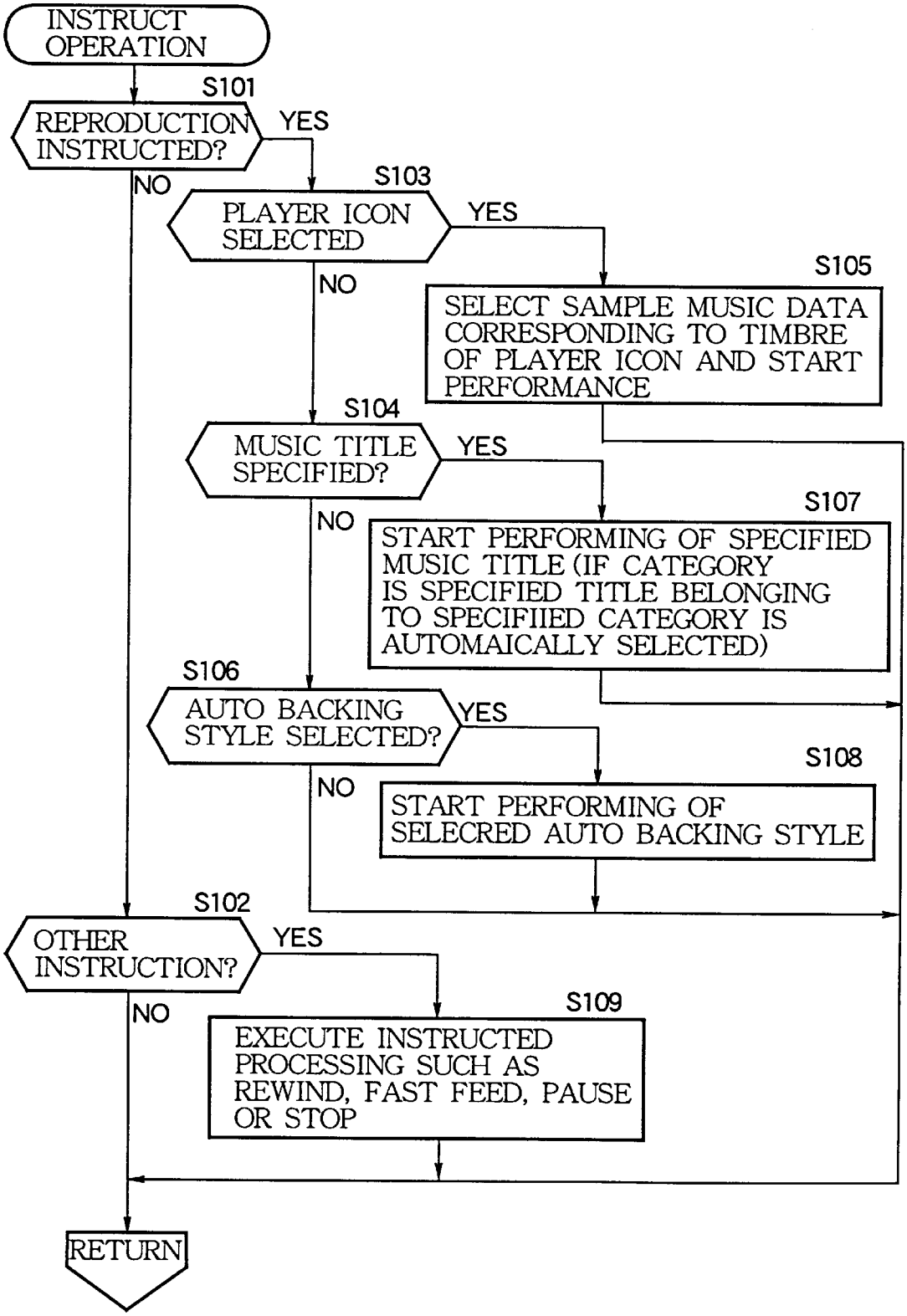
FIG. 16 is a flowchart for an operation instructing step shown in FIG. 12.
Figure 17:
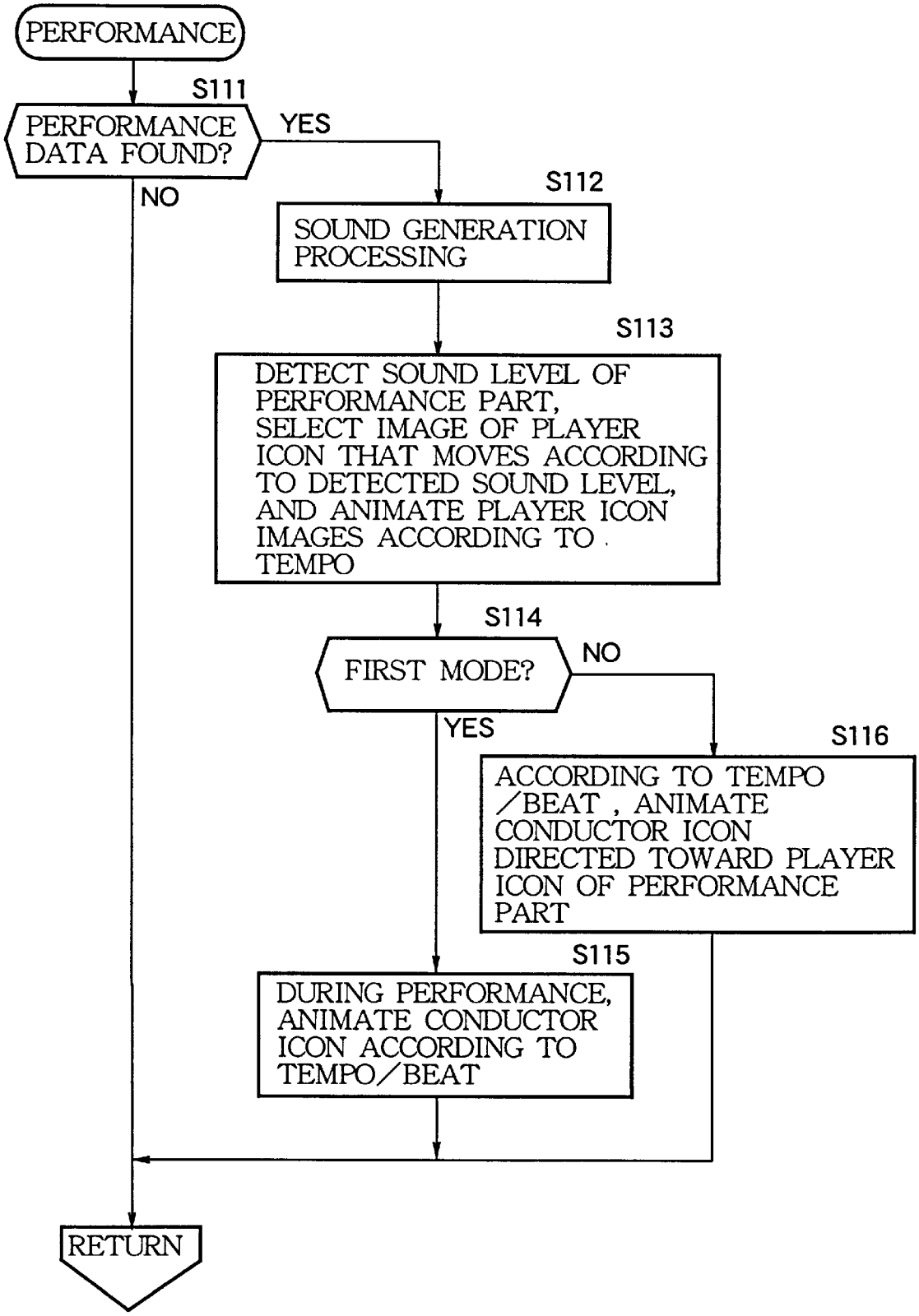
FIG. 17 is a flowchart for a performance step shown in FIG. 12.

FIGS. 12 through 17 are flowcharts describing the music apparatus visually representing the music system practiced as one preferred embodiment of the invention. FIG. 12 is a main flowchart. FIG. 13 is a flowchart of function select step S42 shown in FIG. 12. FIG. 14 is a first flowchart of edit menu processing step S52 shown in FIG. 13. FIG. 15 is a second flowchart of the edit menu processing step S52 shown in FIG. 13. FIG. 16 is a flowchart of operation instruction step S43 shown in FIG. 12. FIG. 17 is a flowchart of performance step S44 shown in FIG. 12.

Now, referring to FIG. 12, registers and so on are initialized in step S41. In step S42, function select processing is executed. In step S43, operation instruction processing is executed. In step S44, performance processing is executed. Then, back in step S42, the function select processing is repeated, followed by the processing of steps S42 through S44. The following describes these steps in detail, but those steps which are not directed or related to the invention are not shown.

In the function select flowchart shown in FIG. 13, it is determined in step S51 whether the edit menu is selected or not. If the decision is yes, edit menu processing is executed in step S52. Otherwise, the processing flow goes to step S53. The edit menu is selected by left-clicking "Edit" in the menu bar of an application window.

The following describes the edit menu processing of step S52. In step S71 shown in FIG. 14, a drop-down menu is displayed. In step S72, it is determined whether "Create Auto Backing Style" in the drop-down menu has been selected by mouse left-clicking. If the decision is yes, the processing flow goes to step S74. Otherwise, the processing flow goes to step S73. In step S74, a dialog box of automatic backing style is displayed. In step S75, the user selects one of the automatic backing styles to set the backing style. Then, the processing flow goes back to step S58 shown in FIG. 13. In the backing style setting, the user sets a music genre, two or more automatic backing data files belonging to the music genre and their sections, the start and end times of period in which this automatic backing is inserted in the music, and so on.

In step S73, it is determined whether "Edit Player" has been selected or not. If the decision is yes, the processing flow goes to step S77. Otherwise, the processing flow goes to step S76. In S77, it is determined whether a player icon has been selected. This decision is based on whether the player icon has already been selected in step S54 shown in FIG. 13 to be described later. If the decision is yes, the processing flow goes to step S78. Otherwise, the processing flow returns to the main flowchart. In step S78, a sub menu opens for selection of volume adjustment, timbre change, and pan adjustment for the performance part corresponding to the selected player icon. When the user selects one of these, a dialog box dedicated to the selected item opens, and the processing flow goes to step S79. In step S79, the user enters a parameter value in the open dialog box, upon which the processing flow returns to step S58 shown in FIG. 13.

In step S76, it is determined whether "Stage Effect" has been selected or not. If the decision is yes, the processing flow goes to step S81. Otherwise, the processing flow goes to step S80. In step S81, the dialog box of "Stage Effect" opens to show a list of stage effect names, upon which processing flow goes to step S82. These stage effects are a kind of the effects to be imparted to the music system. One of the stage effects is reverberation as described with reference to FIG. 1. In step S82, the user selects reverberation type and confirms the selection, upon which the processing flow returns to the main flowchart.

In step S80, it is determined whether "Tune/Beat" has been selected or not. If the decision is yes, the processing flow goes to step S83. Otherwise, the processing flow goes to step S85 shown in FIG. 15. In step S83, a dialog box for selecting a tune or a beat opens, upon which the processing flow goes to step S84. In step S84, the user sets the tune and enters the beat in the head of the music and the start position of a desired bar in the music, upon which the processing flow returns to step S58 shown in FIG. 13.

In step S85 shown in FIG. 15, it is determined whether "Player" has been selected or not. If the decision is yes, the processing flow goes to step S87. Otherwise, the processing flow goes to step S86. In step S87, all player names, to be more specific, timbres (normally indicated by musical instrument names), are displayed in a dialog box, upon which the processing flow goes to step S88. In step S88, the user sets a desired player (or timbre) to each of performance parts for recording or editing, upon which the processing flows returns to step S58 shown in FIG. 13. It should be noted that, for reproduction of music data, a player has been automatically selected by a timbre number (or a program number) specified in the music data file. The selected player may be changed here.

In step S86, it is determined whether "Music Title" has been selected or not. If the decision is yes, the processing flow goes to step S89. Otherwise, the processing flow returns to step S58 shown in FIG. 13. In step S89, a music title select dialog box opens in which music titles classified by music genre are displayed, upon which processing flow goes to step 590. In step S90, the user selects a music title or a music genre and confirms the selection .

FIG. 18 illustrates music title selection. Music titles are grouped by genre. In addition to music titles, the user can select a music genre itself. In this case, a representative title of the selected genre is automatically selected.

When the edit menu processing shown in FIGS. 14 and 15 has come to an end, the processing flow returns to step S58 shown in FIG. 13. In step S58, it is determined whether a setting change has been made in the edit menu processing. If the decision is yes, the processing flow goes to step S59. Otherwise, the processing flow returns to the main flowchart. In step S59, the apparatus changes the screen design of a scenery setting according to the automatic backing style set in step S75 shown in FIG. 14 and according to the stage effect set in step S81. In step S60, the player icon selected in step S88 shown in FIG. 15 is displayed on the performance situation image of the scenery setting. If pan information has been reset in the pan adjustment dialog box of step S78 shown in FIG. 14, the apparatus changes the player icon arrangement according to the new pan information.

FIG. 19 illustrates the relationship between the automatic backing style, the stage effect, and the performance situation image of the scenery setting. The automatic backing styles are classified by music genre. In the figure, the styles of backing or accompaniment are classified by dancing, classical, jazz, and folk. For the stage effect, reverberation is shown here for example. Reverberation includes no reverberation, hall reverberation, and stage reverberation. Different performance situation images are provided based on the combinations of the automatic backing styles and the reverberation types. The apparatus can create performance situation images according to the combinations. In a simple example, the color of curtains in the scenery setting and props such as a speaker box may be changed according to the selected automatic backing style. According to the selected reverberation type, the apparatus may adopt a performance situation image designed after a hall or a stage or, as required, a performance situation image having no curtain at all. Further, by identifying the intensity of reverberation, the apparatus can select performance situation images having different depths and different widths.

Namely, the inventive method is designed for displaying a visual image of a music system that is constructed to play at least one performance part with a particular timbre and that is applied with a specific combination of an acoustic effect and an accompaniment style. The inventive method is carried out by the steps of analyzing data associated to the music system to discriminate the specific combination of the acoustic effect and the accompaniment style applied to the music system and to discriminate the particular timbre allotted to the performance part of the music system, providing a picture of a virtual setting in matching with the discriminated specific combination of the acoustic effect and the accompaniment style such that the picture of the virtual setting visualizes a situation and environment in which the music system should be played with the specific combination of the acoustic effect and the accompaniment style, providing an icon in correspondence with the discriminated particular timbre such that the icon symbolizes playing of the performance part with the allotted timbre, and arranging the icon of the performance part in the picture of the virtual setting to thereby synthesize the visual image of the music system.

Figure 20:
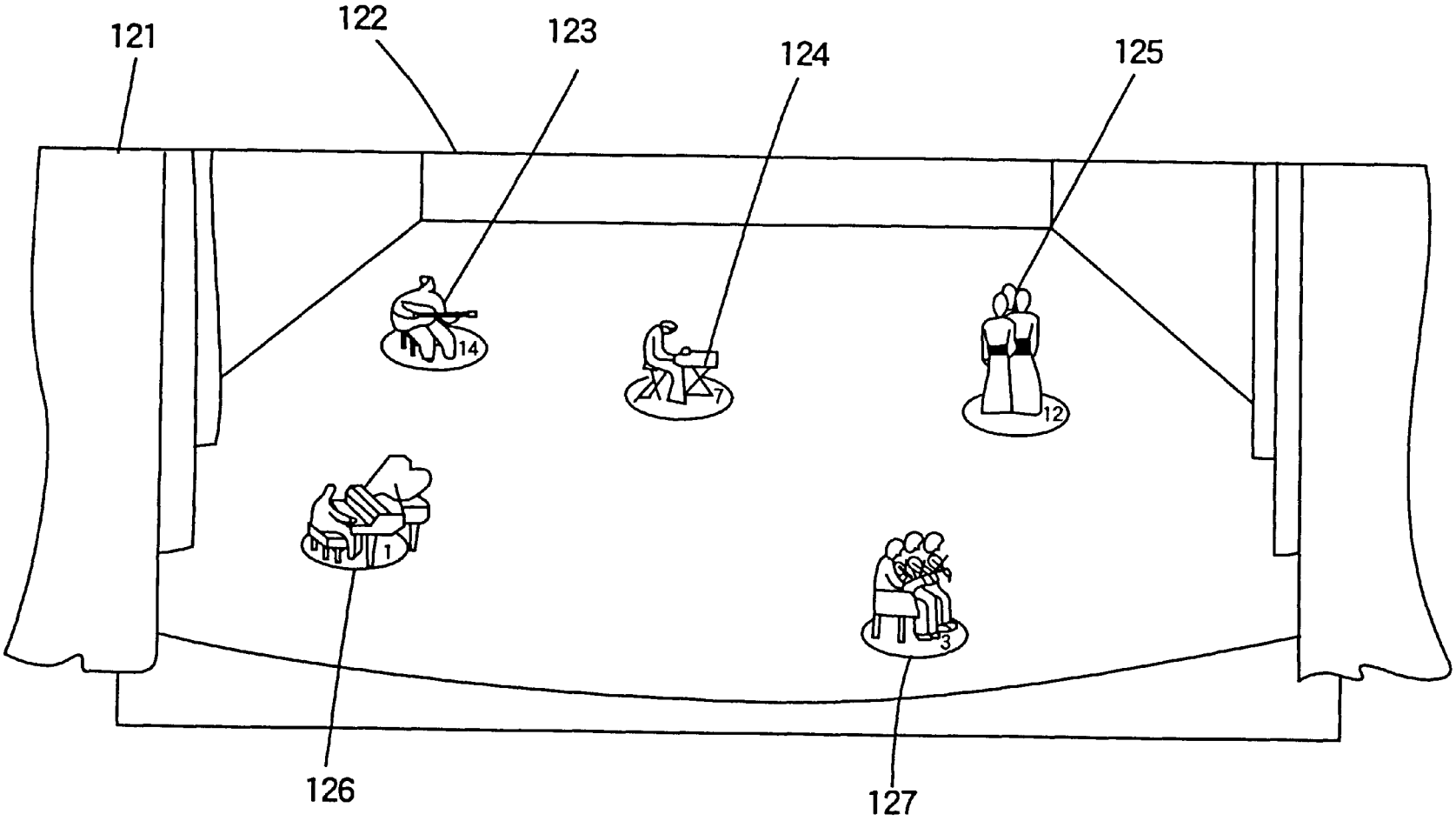
FIG. 20 is a diagram illustrating a first specific example of an image of a scenery setting in which player icons are arranged.
Figure 21:
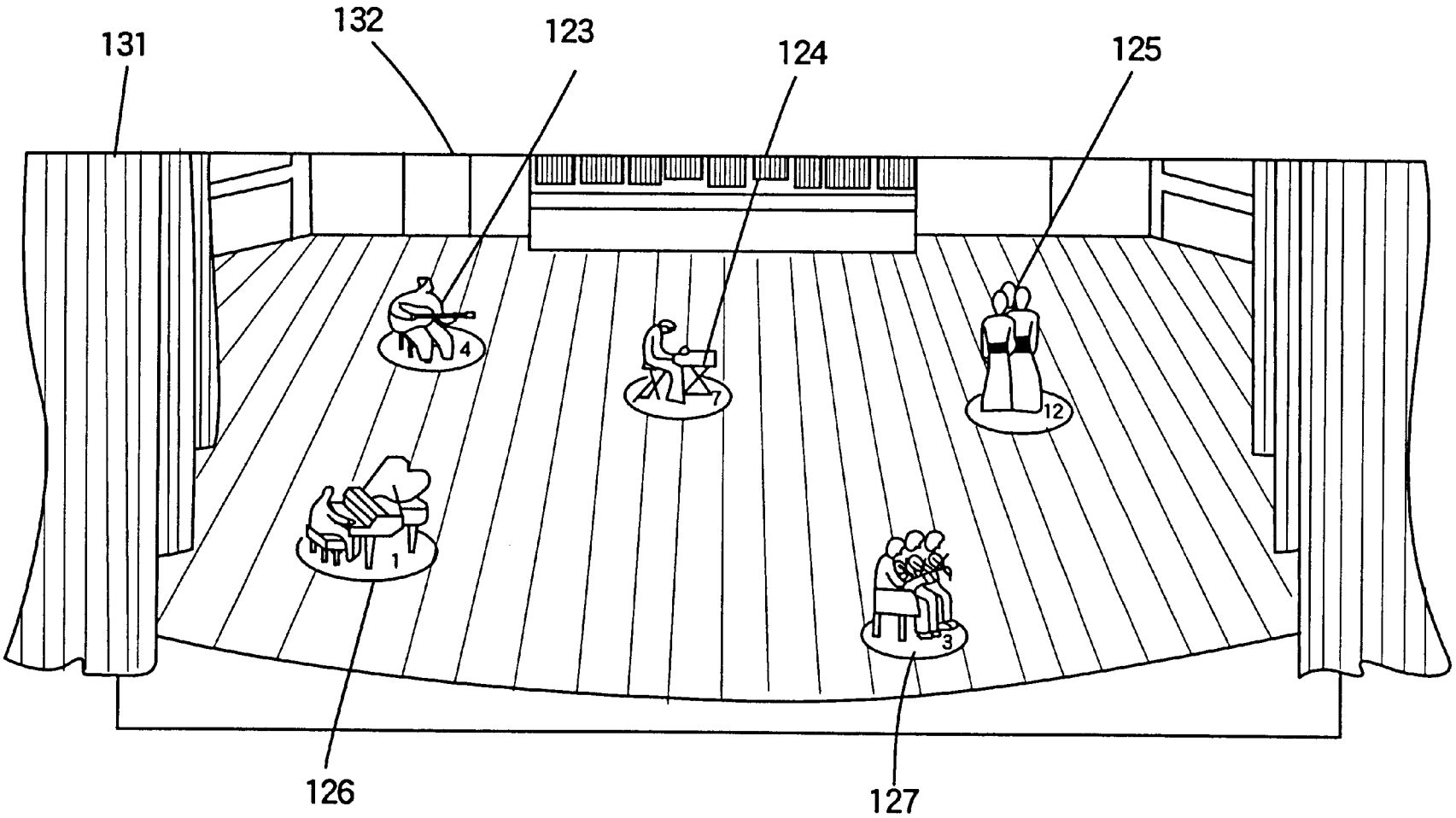
FIG. 21 is a diagram illustrating a second specific example of the image of a scenery setting in which player icons are arranged.
Figure 22:
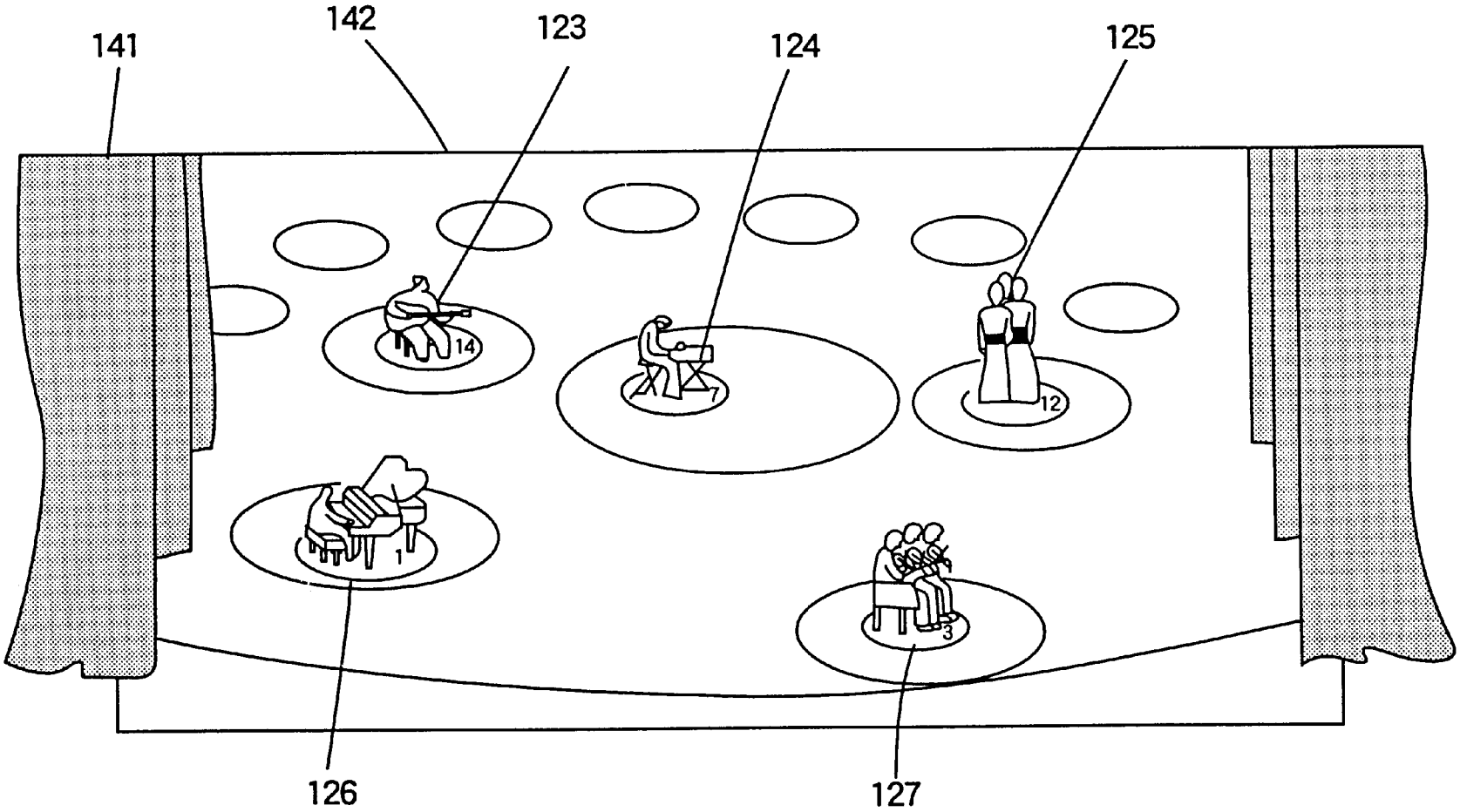
FIG. 22 is a diagram illustrating a third specific example of the image of a scenery setting in which player icons are arranged.

FIGS. 20 through 22 illustrate specific examples of the performance situation images with player icons arranged. It should be noted that these pictures are not especially related to the list of FIG. 19. Referring to FIG. 20, a stage 122 is three-dimensionally drawn between open curtains 121. The stage 122 carries a guitar player icon 123, an electronic piano player icon 124, a vocal player icon 125, a piano player icon 126, and a violin player icon 127. For a performance situation image, this is rather simplistic and therefore used for a situation in which no stage effect is set.

The vocal player icon 125 is an icon indicative of a performance part in which vocal is treated as a kind of musical instrument timbre. In some cases, the words are sounded from this icon. The vocal player icon 125 is composed of three female vocalists, indicating that chorus effect is imparted to this performance part. If no chorus effect need be imparted, this icon may be composed of a single vocalist. Also, this icon may be composed of male vocalists. The violin player icon 127 is also composed of three violinists, indicating that an ensemble effect is imparted to this performance part. If no ensemble effect need be imparted, this icon may be composed of a single violinist. If required, a performance part number may be shown in the oval drawn after a spot light at the feet of player symbols.

Referring to FIG. 21, a stage 132 is three-dimensionally drawn between open curtains 131, which are different from those shown in FIG. 20 in color and pattern. The stage 132 is imaged after a concert hall having a wooden floor and wooden walls.

Referring to FIG. 22, a stage 142 is three-dimensionally drawn between open curtains 141, which are different from those shown in FIGS. 20 and 21 in color and pattern. The stage 142 is imaged after a live stage made visible by spot lights. Thus, the realism of a live performance can be enhanced by changing the performance situation image according to such effects for the music system as automatic backing style and stage effect, in other words, the environment setting of the music system.

Now, referring to the flowchart shown in FIG. 13 again, if the edit menu is not selected in step S51, the processing flow goes to step S53. In step S53, it is determined whether a player icon arranged in the performance situation image has been selected or not. If the decision is yes, the processing flow goes to step S54. Otherwise, the processing flow returns to the main flowchart. The player icon selection is determined when the player icon has been left-clicked with the mouse.

In step S54, a frame enclosing the selected player icon is shown to visually indicate the selection of that icon, upon which the processing flows goes to step S55. In step S55, it is determined whether the movement of the player icon has been instructed or not. If the decision is yes, the processing flow goes to step S56. Otherwise, the processing flow returns to the main flowchart. The movement of the icon is determined if the icon has been dragged with the mouse while the left button is kept pressed. In step S56, the apparatus changes the display position of the player icon, upon which the processing flow goes to step S57. In step S57, the apparatus sets pan control of the performance part corresponding to the selected player icon according to its lateral position, upon which the processing flow returns to the main flowchart. The details of this processing are described with reference to FIGS. 1 and 2.

The player icon of the performance part used in this piece of music is displayed at the position defined by the pan information, with the file data of this piece of music captured in the music apparatus. Moving the position of this player icon, the user can change the pan settings. This is also practicable after music selection or with a user-edited piece of music.

Now, referring to FIG. 16, the processing flow of the operation instruction of step S43 of FIG. 12 will be described in detail. In step S101, it is determined whether reproduction has been instructed or not. If the decision is yes, the processing flow goes to step S103. Otherwise, the processing flow goes to step S102. In the present embodiment, the instruction for reproduction is triggered when a reproduction button on the control panel of a virtual recording/reproducing device displayed in the image is left-clicked with the mouse.

In step S103, it is determined whether any one of the player icons arranged in the scenery setting of the performance situation image has been selected or not. If the decision is yes, the processing flow goes to step S105. Otherwise, the processing flow goes to step S104. The selection of the player icon is made in step S53 shown in FIG. 13. When the player icon is selected, the marking frame described in step S54 is displayed on the screen.

In step S105, the sample music data corresponding to the timbre of the selected player icon is read out to start an audition performance. In addition to the information about individual notes and timbre, the sample music data includes duration information indicative of the time interval between sound generating events, by way of example. This data is sequence data of a file format convertible into sound waveform data in the tone generator block. A specific example of this data is composed of a standard MIDI file (SMF). This sample music data constitutes a piece of music that is coherent to a certain degree. A specific example is one or more bars of phrase data. The whole piece of music may also be used for the sample music data. It should be noted that the sample music data may be a wave format file. In this case, only a D/A converting capability for converting digital waveform data into an analog waveform may only be provided. However, the size of data to be stored significantly increases.

As described above, the inventive method is designed for determining a sample of music data for use in auditioning a timbre allotted to a performance part of a music system. The inventive method is carried out by the steps of analyzing data representative of the music system to discriminate timbres allotted to performance parts constituting the music system, providing icons in correspondence with the discriminated timbres such that the icons symbolize playing of the performance parts with the allotted timbres, providing a picture of a virtual setting to visualize a situation and environment of the music system, arranging the icons of the performance parts in the picture of the virtual setting to thereby synthesize a visual image of the music system, and selecting one of the icons arranged in the visual image of the music system so as to determine a sample of music data for use in auditioning the timbre allotted to the selected performance part of the music system.

For the sample music data, a phrase in the piece of music suitable for auditioning the timbre of the performance part is selected. The user test-listens to this sample music data to check if the timbre of this performance part is suitable for the piece of music to be performed or edited. Therefore, the user specifies the genre of the music, the style of the music, and whether this performance part is for melody or backing. Then, the user selects beforehand a piece of music matching the specified style from among the pieces belonging to the specified genre, and stores, for both melody and backing, the sequence data extracted from the selected piece of music, that is suitable for test-listening to the timbre.

The above-mentioned selection is made by the user for the selected performance part in step S105 by displaying a pop-up menu, by way of example. It should be noted that the user need not especially set the music genre in step S105 if the music piece or automatic backing style is already set. In such a case, the music genre of the preset music piece or automatic backing style is automatically identified as the genre of the music piece to be performed or edited.

As described above, the inventive method is designed for determining a sample of music data for use in auditioning a performance part of a music system that is applicable to perform a music of various genres. The inventive method is carried out by the steps of identifying a genre of the music to be performed by the music system, analyzing data representative of the music system to discriminate a timbre allotted to the performance part of the music system, and determining a sample of music data for use in auditioning the performance part according to the identified genre and the discriminated timbre.

Further, the sample music data may be determined according to the tempo of the music to be performed. Namely, the inventive method is designed for determining a sample of music data for use in auditioning a performance part of a music system that is adaptable to perform a music at a variable tempo. The inventive method is carried out by the steps of specifying a tempo of the music to be performed by the music system, analyzing data representative of the music system to discriminate a timbre allotted to the performance part of the music system, and determining a sample of music data for use in auditioning the performance part according to the specified tempo and the discriminated timbre.

The distinction between the melody part and the backing part may also be set in a manner interlocked with the player icon arrangement. In this case, the user need not especially set the distinction in this step. In the above-mentioned example, the sample music data is changed by various conditions such as the music genre in addition to the timbre. Setting the sample music data based on the timbre alone also allows the user to easily evaluate characteristics of a particular timbre.

In step S105 shown in FIG. 16, when the sample music data is selected corresponding to the timbre of the player icon, this data is captured in a performance data buffer, placing the music system in a performance start state, upon which the processing flow returns to the main flowchart. On the other hand, in step S104, it is determined whether music specification has been made or not. If the decision is yes, the processing flow goes to step S107. Otherwise, the processing flows goes to step S106. It should be noted that music setting has been made in step S90 shown in FIG. 15. In step S107, the music data of the specified piece of music is captured in the performance data buffer, placing the music system in the performance start state, upon which the processing flow returns to the main flowchart.

In step S106, it is determined whether an automatic backing style has been selected or not. If the decision is yes, the processing flow goes to step S108. Otherwise, the processing flow returns to the main flowchart. In step S108, the backing music data of the selected automatic backing style is captured in the performance data buffer, placing the music system in the performance start state, upon which the processing flow returns to the main flowchart.

In step S102, it is determined whether other instruction has been issued. If the decision is yes, the processing flow goes to step S109. Otherwise, the processing flows returns to the main flowchart. In step S109, instructed processing such as rewind, fast feed, pause, or stop is executed. The issuance of this instruction is determined when the button of rewind, fast feed, pause, or stop on the virtual recording/reproducing device displayed on the screen has been left-clicked.

Referring to a performance flowchart shown in FIG. 17, it is determined in step S111 whether music data is held in the performance data buffer. If the decision is yes, the processing flow goes to step S112. Otherwise, the processing flow returns to the main flowchart. In step S112, sound reproduction processing Is executed based on note-on data sequentially retrieved from the performance data buffer. Then, the processing flow goes to step S113. In steps S113 through S115, the player icons and the conductor icon are displayed in animation. First, in step S113, the sound level of the performance part during the sound generation is detected and the player icon images that provide a motion in response to the detected sound level are selected. Thus, according to the sounding level, the motion of each corresponding player icon is made large or small. At the same time, the player icon images are animated according to the tempo, upon which the processing flow goes to step S114.

The sound generation period of each performance part is started by detecting a sound generating instruction (equivalent to "note-on" in MIDI) of each performance part. The end of the sound generation period of each performance part is detected in several manners. First, the point of time at which the sound of each performance part goes off is detected. To be more specific, the point of time at which the envelope of the sound becomes zero or lower than a predetermined threshold is detected. Second, the sound generating state of each performance part coming to be detected over a predetermined period of time is detected.

In either detecting method, if another sound generating command comes during the current sound generating period, the player icon images representing a sequence of motions may be returned to the first one. This allows the motion of a player icon to start from the beginning every time a performance part sound generating command comes. In addition, it is specified that only one sound generating command is not allowed to repetitively use the same player icon image. Consequently, even in the case of musical instruments such as guitar that are visually conspicuous in the difference between playing forms, at start of sound generation and during subsequent sound generating period, the motion of the player icon is saved from becoming awkward.

In step S114, it is determined whether a first mode is on. If the decision is yes, the processing flow goes to step S115. If a second mode is on, the processing goes to step S116. In step S115, the conductor icon images are switched according to the tempo and beat always during the performance period including a time in which no sound is generated. Then, the processing flow returns to the main flowchart. Therefore, in the first mode, during the performance period when automatically performing one piece of music for example, including a time in which no performance part is generating a sound, the conductor icon images are always switched to impart a motion to the conductor icon.

In the second mode at step S116, a motion is imparted to the conductor icon only during the performance period and when any one of the performance parts is generating a sound. In the sound generating period of any one of the performance parts, the image of the conductor icon directed toward the player icon of the sound generating performance part is displayed. At the same time, a sequence of images matching the beat are repeatedly displayed and switched in response to the tempo. To do so, several sets of images having different conductor orientations are prepared as the images for providing a sequence of conductor motions. The user selects an appropriate set of images based on the angle from the conductor icon position to the position of the player icon that is generating a sound.

In the above-mentioned examples, the player icon and conductor icon images are stored in the image data memories as plural still images representing sequences of motions. These stored images are read out to be sequentially changed over, thereby imparting a sequence of motions to each icon. Decreasing the number of these still images accordingly decreases the size of the image data to be stored and lessens the processing overhead of image animating. Conversely, increasing the number of still images, 30 frames per second for example, and decreasing the image switching interval smoothes icon motions for enhanced display quality. If there are only small number of basic still images, the icon motions may be smoothed by interpolating the still image data to create an intermediate still image with these still images used as key frames. This technology is known as an animation creating technology in the field of three-dimensional computer graphics for example.

As described, the player icon position indicates the pan setting state and the motions of the player, and the conductor icon indicates the performance state, so that the user can grasp the state of the music system at one glance. It should be noted that the performance situation image may be drawn with an auditorium to display an audience. Multiple pieces of image data may be prepared to represent an excited audience. These image data are stored in the performance situation image data memory 4. When the occurrence of the performance data of key-on event for example is frequent, it is assumed that the performance is high, and the set of images representing the excited audience are sequentially displayed, further enhancing the feeling of being at a live performance. In addition, an excited audience may be displayed when outputting an effect sound such as the sound of cheering and clapping.

In the above-mentioned examples, the automatic backing styles, stage effects, tune and beat, and timbres are set by use of the edit menu. These conditions may also be set by displaying corresponding icons on the screen of an application window for the user to select. When the user clicks one of these icons, a pop-up menu opens.

In the above-mentioned examples, the sample music data and automatic backing styles are performed by clicking the play button with the mouse like ordinary music reproduction. Alternatively, an automatic backing style may be performed by clicking a test-listening check button when executing automatic backing style setting in the automatic backing style dialog box in the edit menu. Likewise, the auditioning of a timbre may be made by clicking the test-listening check button when executing timbre setting in the timbre change dialog box in the edit menu.

As described and according to the invention, a music system can be represented visually. This novel constitution allows the user to enjoy a performance without visually getting bored. In addition, the novel constitution allows the user to more correctly comprehend auditory information by looking at the corresponding visual information displayed on the screen.

The novel constitution visually represents the performance state and performance period of each performance part by a change of icons representing the timbres of respective performance parts. Consequently, the user can visually comprehend a performance part that is generating sound, while enjoying the progression of music.

Further, the novel constitution allows the user to easily distinguish between different timbres by selecting the sample music data suitable for the user environment. The novel constitution also allows the user to easily select timbres that constitute a piece of music. This facilitates the evaluation of the characteristics of timbres by musically appropriate images, hence a great help is provided especially for novice users in music composition.

While the preferred embodiments of the present invention have been described using specific terms, such description is for illustrative purposes only, and it is to be understood that changes and variations may be made without departing from the spirit or scope of the appended claims.

What is claimed is:

1. A method of displaying a visual image of a music system that is constructed to play at least one performance part with a particular timbre and that is acoustically characterized by a specific effect, the method comprising the steps of:

analyzing data representative of the music system to discriminate the specific effect applied to the music system and to discriminate the particular timbre allotted to the performance part of the music system;

providing a picture of a virtual setting which is set in matching with the discriminated specific effect such that the picture of the virtual setting visualizes a situation and environment in which the music system should be played with the specific effect;

providing an icon in correspondence with the discriminated particular timbre such that the icon symbolizes playing of the performance part with the allotted timbre; and arranging the icon of the performance part in the picture of the virtual setting to thereby synthesize the visual image of the music system.

2. A method of displaying a visual image of a music system that is constructed to play at least one performance part with a particular timbre and that is accompanied by a specific style of an accompaniment, the method comprising the steps of:

analyzing data associated to the music system to discriminate the specific style applied to the music system and to discriminate the particular timbre allotted to the performance part of the music system;

providing a picture of a virtual setting which is set in matching with the discriminated specific style such that the picture of the virtual setting visualizes a situation and environment in which the music system should be played with the specific style;

providing an icon in correspondence with the discriminated particular timbre such that the icon symbolizes playing of the performance part with the allotted timbre; and arranging the icon of the performance part in the picture of the virtual setting to thereby synthesize the visual image of the music system.

3. A method of displaying a visual image of a music system that is constructed to play at least one performance part with a particular timbre and that Is applied with a specific combination of an acoustic effect and an accompaniment style, the method comprising the steps of:

analyzing data associated to the music system to discriminate the specific combination of the acoustic effect and the accompaniment style applied to the music system and to discriminate the particular timbre allotted to the performance part of the music system;

providing a picture of a virtual setting which is set in matching with the discriminated specific combination of the acoustic effect and the accompaniment style such that the picture of the virtual setting visualizes a situation and environment in which the music system should be played with the specific combination of the acoustic effect and the accompaniment style;

providing an icon in correspondence with the discriminated particular timbre such that the icon symbolizes playing of the performance part with the allotted timbre; and arranging the icon of the performance part in the picture of the virtual setting to thereby synthesize the visual image of the music system.

4. A method of displaying a visual image of a music system that is constructed to play at least one performance part with a particular timbre and a desired lateral pan, the method comprising the steps of:

analyzing data representative of the music system to discriminate the particular timbre allotted to the performance part of the music system;

providing an icon in correspondence with the discriminated particular timbre such that the icon symbolizes playing of the performance part with the allotted timbre;

providing a picture of a virtual setting to visualize a situation and environment designed for the music system, the picture of the virtual setting being divided into a sensitive zone and an insensitive zone;

locating the icon of the performance part at a desired lateral position in the picture of the virtual setting to thereby synthesize the visual image of the music system;

determining the lateral pan of the performance part dependently on the lateral position of the icon when the icon is located within the sensitive zone of the picture; and otherwise determining a flat lateral pan for the performance part regardless of the lateral position of the icon when the icon is located within the insensitive zone of the picture.

5. The method according to claim 4, wherein the step of providing a picture comprises providing a picture of a virtual setting to visualize a three-dimensional situation and environment having depth positions such that the icon can be located at a depth position in addition to the lateral position, the method further comprising the step of determining a sound volume of the performance part dependently on the depth position of the icon located in the picture.

6. A method of displaying a visual image of a music system that is constructed to play at least one performance part with a particular timbre and a lateral pan, the method comprising the steps of:

analyzing data associated to the music system to discriminate the particular timbre allotted to the performance part of the music system and to discriminate the lateral pan applied to the performance part;

providing an icon in correspondence with the discriminated particular timbre such that the icon symbolizes playing of the performance part with the allotted timbre;

providing a picture of a virtual setting to visualize a situation and environment designed for the music system; and locating the icon of the performance part at a lateral position in the picture of the virtual setting in accordance with the discriminated lateral pan to thereby synthesize the visual image of the music system.

7. A method of displaying a visual image of a music system that is constructed to play at least one performance part with a particular timbre and a sound volume, the method comprising the steps of:

analyzing data representative of the music system to discriminate the particular timbre allotted to the performance part of the music system and to detect the sound volume set to the performance part;

providing an icon in correspondence with the discriminated particular timbre such that the icon symbolizes playing of the performance part with the allotted timbre;

providing a picture of a virtual setting to visualize a three-dimensional situation and environment having depth positions for accommodating the music system; and locating the icon of the performance part at a depth position in the picture of the virtual setting in accordance with the detected sound volume to thereby synthesize the visual image of the music system.

8. A method of displaying a visual image of playing at least one performance part with a particular timbre in a music system, the method comprising the steps of:

analyzing data representative of the music system to discriminate the particular timbre allotted to the performance part of the music system;

synthesizing a picture containing an icon designed in correspondence with the discriminated particular timbre;

providing a command to start generation of a sound having the particular timbre according to the data of the music system to thereby play the performance part of the music system; and starting animation of the icon in response to the command so that the icon visualizes the playing of the performance part with the allotted timbre.

9. The method according to claim 8, wherein the icon is animated by changing a plurality of still images of the icon.

10. A method of displaying a visual image of playing a music system containing performance parts having a particular timbres, the method comprising the steps of:

analyzing data representative of the music system to discriminate the particular timbre allotted to each performance part of the music system;

synthesizing a picture containing a player icon corresponding to the discriminated particular timbre and symbolizing each performance part of the music system, and a conductor icon symbolizing a conductor of the music system;

generating a sound according to the data of the music system to thereby play each performance part of the music system; and animating the conductor icon in matching with the sound associated to each performance part so as to visualize the playing of the music system.

11. The method according to claim 10, wherein the conductor icon is animated by changing a plurality of still images of the conductor.

12. A method of determining a sample of music data for use in auditioning a timbre allotted to a performance part of a music system, the method comprising the steps of:

analyzing data representative of the music system to discriminate timbres allotted to performance parts constituting the music system;

providing icons in correspondence with the discriminated timbres such that the icons symbolize playing of the performance parts with the allotted timbres;

providing a picture of a virtual setting to visualize a situation and environment of the music system;

arranging the icons of the performance parts in the picture of the virtual setting to thereby synthesize a visual image of the music system; and selecting one of the icons arranged in the visual image of the music system so as to determine a sample of music data for use in auditioning the timbre allotted to the performance part symbolized by the selected icon.

13. A method of determining a sample of music data for use in auditioning a performance part of a music system that is applicable to perform a music of various genres, the method comprising the steps of:

identifying a genre of the music to be performed by the music system;

analyzing data representative of the music system to discriminate a timbre allotted to the performance part of the music system; and determining a sample of music data for use in auditioning the performance part according to the identified genre and the discriminated timbre.

14. A method of determining a sample of music data for use in auditioning a performance part of a music system that is adaptable to perform a music at a variable tempo, the method comprising the steps of:

specifying a tempo of the music to be performed by the music system;

analyzing data representative of the music system to discriminate a timbre allotted to the performance part of the music system; and determining a sample of music data for use in auditioning the performance part according to the specified tempo and the discriminated timbre.

15. A method of determining a sample of music data for use in auditioning performance parts of a music system, the method comprising the steps of:

analyzing data representative of the music system to discriminate timbres allotted to the performance parts constituting the music system;

providing icons in correspondence with the discriminated timbres such that the icons symbolize playing of the performance parts with the allotted timbres;

providing a picture of a virtual setting to visualize a situation and environment of the music system, the picture containing a melody area and a backing area;

arranging a location of each icon of each performance part in either of the melody area and the backing area on the picture of the virtual setting to thereby synthesize a visual image of the music system, some performance part being allocated to the melody area for playing a melody while other performance part being allocated to the backing area for backing the melody; and selecting one of the icons arranged in the visual image of the music system so as to determine a sample of music data for use in auditioning the performance part of the selected icon, according to the timbre allotted to the performance part of the selected icon and according to the location of the selected icon relative to the melody area and the backing area.

16. A computer readable medium for use in a computer having a central processor and a monitor display, the medium containing program instructions executable by the central processor for causing the computer to carry out a process of displaying a visual image of a music system on the monitor display, the music system being constructed to play at least one performance part with a particular timbre and being modified by an acoustic effect, wherein the process comprises the steps of:

analyzing data representative of the music system to identify the acoustic effect applied to the music system and to discriminate the particular timbre allotted to the performance part of the music system;

providing a picture of a scenery setting which is set in matching with the identified acoustic effect such that the picture of the scenery setting visualizes a situation and environment by which the music system can present the identified acoustic effect;

providing an icon in correspondence to the discriminated particular timbre such that the icon symbolizes playing of the performance part with the allotted timbre; and arranging the icon of the performance part in the picture of the scenery setting to thereby synthesize the visual image of the music system.

17. A computer readable medium for use in a computer having a central processor and a monitor display, the medium containing program instructions executable by the central processor for causing the computer to carry out a process of displaying a visual image of a music system on the monitor display, the music system being constructed to play at least one performance part with a particular timbre and being accompanied by a specific style of an accompaniment, wherein the process comprises the steps of:

analyzing data associated to the music system to identify the specific style applied to the music system and to discriminate the particular timbre allotted to the performance part of the music system;

providing a picture of a scenery setting which is set in matching with the identified specific style such that the picture of the scenery setting visualizes a situation and environment by which the music system can present the specific style of the accompaniment;

providing an icon in correspondence to the discriminated particular timbre such that the icon symbolizes playing of the performance part with the allotted timbre; and arranging the icon of the performance part in the picture of the scenery setting to thereby synthesize the visual image of the music system.

18. A computer readable medium for use in a computer having a central processor and a monitor display, the medium containing program instructions executable by the central processor for causing the computer to carry out a process of displaying a visual image of a music system on the monitor display, the music system being constructed to play at least one performance part with a particular timbre and being applied with a specific combination of an acoustic effect and an accompaniment style, wherein the process comprises the steps of:

analyzing data associated to the music system to identify the specific combination of the acoustic effect and the accompaniment style applied to the music system and to discriminate the particular timbre allotted to the performance part of the music system;

providing a picture of a scenery setting which is set in matching with the identified specific combination of the acoustic effect and the accompaniment style such that the picture of the scenery setting visualizes a situation and environment by which the music system can present the specific combination of the acoustic effect and the accompaniment style;

providing an icon in correspondence to the discriminated particular timbre such that the icon symbolizes playing of the performance part with the allotted timbre; and arranging the icon of the performance part in the picture of the scenery setting to thereby synthesize the visual image of the music system.

19. A computer readable medium for use in a computer having a central processor and a monitor display, the medium containing program instructions executable by the central processor for causing the computer to carry out a process of displaying a visual image of a music system on the monitor display, the music system being constructed to play at least one performance part with a particular timbre and a lateral pan, wherein the process comprises the steps of:

analyzing data representative of the music system to discriminate the particular timbre allotted to the performance part of the music system;

providing an icon in correspondence to the discriminated particular timbre such that the icon symbolizes playing of the performance part with the allotted timbre;

providing a picture of a scenery setting to visualize a situation and environment designed for the music system, the picture of the scenery setting being divided into a sensitive zone and an insensitive zone;

locating the icon of the performance part at a lateral position in the picture of the scenery setting to thereby synthesize the visual image of the music system;

determining the lateral pan of the performance part dependently on the lateral position of the icon when the icon is located within the sensitive zone of the picture; and otherwise determining a fixed lateral pan for the performance part regardless of the lateral position of the icon when the icon is located within the insensitive zone of the picture.

20. A computer readable medium for use in a computer having a central processor and a monitor display, the medium containing program instructions executable by the central processor for causing the computer to carry out a process of displaying a visual image of a music system on the monitor display, the music system being constructed to play at least one performance part with a particular timbre and a lateral pan, wherein the process comprises the steps of:

analyzing data associated to the music system to discriminate the particular timbre allotted to the performance part of the music system and to detect the lateral pan applied to the performance part;

providing an icon in correspondence to the discriminated particular timbre such that the icon symbolizes playing of the performance part with the allotted timbre;

providing a picture of a scenery setting to visualize a situation and environment designed for the music system; and locating the icon of the performance part at a lateral position in the picture of the scenery setting in accordance with the detected lateral pan to thereby synthesize the visual image of the music system.

21. A computer readable medium for use in a computer having a central processor and a monitor display, the medium containing program instructions executable by the central processor for causing the computer to carry out a process of displaying a visual image of a music system on the monitor display, the music system being constructed to play at least one performance part with a particular timbre and a sound volume, wherein the process comprises the steps of:

analyzing data representative of the music system to discriminate the particular timbre allotted to the performance part of the music system and to detect the sound volume set to the performance part;

providing an icon in correspondence to the discriminated particular timbre such that the icon symbolizes playing of the performance part with the allotted timbre;

providing a picture of a three-dimensional scenery setting to visualize a situation and environment of the music system, the three-dimensional scenery setting having depth positions for accommodating the music system; and locating the icon of the performance part at a depth position in the picture of the three-dimensional scenery setting in accordance with the detected sound volume to thereby synthesize the visual image of the music system.

22. A computer readable medium for use in a computer having a central processor and a monitor display, the medium containing program instructions executable by the central processor for causing the computer to carry out a process of displaying a visual image of playing at least one performance part with a particular timbre in a music system by means of the monitor display, wherein the process comprises the steps of:

analyzing data associated to the music system so as to discriminate the particular timbre allotted to the performance part of the music system;

synthesizing a picture containing an icon designed in correspondence to the discriminated particular timbre;

providing a command to start generation of a sound having the particular timbre according to the data associated to the music system to thereby play the performance part of the music system; and starting animation of the icon in response to the command so that the icon visualizes the playing of the performance part with the allotted timbre.

23. The computer readable medium according to claim 22, wherein the icon is animated by changing a plurality of still images of the icon.

24. A computer readable medium for use in a computer having a central processor and a monitor display, the medium containing program instructions executable by the central processor for causing the computer to carry out a process of displaying a visual image of playing a music system on the monitor display, the music system being composed of performance parts having various timbres, wherein the process comprises the steps of:

analyzing data associated to the music system to discriminate various timbres allotted to respective performance parts of the music system;

synthesizing a picture containing player icons corresponding to the discriminated various timbres and symbolizing the respective performance parts of the music system, and a conductor icon symbolizing a conductor for conducting the music system;

generating sounds according to the data associated to the music system to thereby play the music system; and animating the conductor icon in matching with the sounds associated to respective performance parts so as to visualize the playing of the music system.

25. The computer readable medium according to claim 24, wherein the conductor icon is animated by changing a plurality of still images of the conductor.

26. A computer readable medium for use in a computer having a central processor, the medium containing program instructions executable by the central processor for causing the computer to carry out a process of determining sample music data for use in audibly testing a timbre allotted to a performance part of a music system, wherein the process comprises the steps of:

analyzing data representative of the music system to discriminate timbres allotted to respective performance parts constituting the music system;

providing icons in correspondence to the discriminated timbres such that the icons symbolize playing of the respective performance parts with the allotted timbres;

providing a picture of a scenery setting to visualize a situation and environment designed for the music system;

arranging the icons of the respective performance parts in the picture of the scenery setting to thereby synthesize a visual image of the music system; and selecting one of the icons arranged in the visual image of the music system so as to determine the sample music data for use in audibly testing the timbre allotted to the performance part of the selected icon.

27. A computer readable medium for use in a computer having a central processor, the medium containing program instructions executable by the central processor for causing the computer to carry out a process of determining sample music data for use in audibly testing a performance part of a music system that is adaptable to perform a music of various genres, wherein the process comprises the steps of:

identifying a genre of the music to be performed by the music system;

analyzing data representative of the music system to discriminate a timbre allotted to the performance part of the music system; and determining the sample music data for use in audibly testing the performance part according to the identified genre and the discriminated timbre.

28. A computer readable medium for use in a computer having a central processor, the medium containing program instructions executable by the central processor for causing the computer to carry out a process of determining sample music data for use in audibly testing a performance part of a music system that is configurable to perform a music at a variable tempo, wherein the process comprises the steps of:

specifying a tempo of the music to be performed by the music system;

analyzing data representative of the music system to discriminate a timbre allotted to the performance part of the music system; and determining the sample music data for use in audibly testing the performance part according to the specified tempo and the discriminated timbre.

29. A computer readable medium for use in a computer having a central processor, the medium containing program instructions executable by the central processor for causing the computer to carry out a process of determining sample music data for use in audibly testing performance parts of a music system, wherein the process comprises the steps of:

analyzing data representative of the music system to discriminate timbres allotted to respective performance parts constituting the music system;

providing icons in correspondence to the discriminated timbres such that the icons symbolize playing of the respective performance parts with the allotted timbres;

providing a picture of a scenery setting to visualize a situation and environment designed for the music system, the picture containing a melody area and a backing area;

specifying a location of each icon of each performance part in either of the melody area and the backing area on the picture of the scenery setting to thereby synthesize a visual image of the music system, some performance part being located in the melody area for playing a melody while other performance part being located in the backing area for backing the melody; and selecting one of the icons arranged in the visual image of the music system so as to determine sample music data for use in audibly testing the performance part of the selected icon, according to the timbre allotted to the performance part of the selected icon and according to the location of the selected icon with respect to the melody area and the backing area.

30. A music apparatus comprising a sound source for playing a music system containing at least one performance part with a particular timbre while applying an acoustic effect to the music system, a monitor display for displaying a visual image of the music system, and a central processor for executing the process comprising the steps of:

analyzing data representative of the music system to identify the acoustic effect applied to the music system and to discriminate the particular timbre allotted to the performance part of the music system;

providing a picture of a scenery setting which is set in matching with the identified acoustic effect such that the picture of the scenery setting visualizes a situation and environment in which the identified acoustic effect is applied to the music system;

providing an icon in correspondence to the discriminated particular timbre such that the icon symbolizes playing of the performance part with the allotted timbre; and arranging the icon of the performance part in the picture of the scenery setting to thereby synthesize the visual image of the music system, which is displayed on the monitor display.

31. A music apparatus comprising a sound source for playing a music system containing at least one performance part with a particular timbre while a specific style of an accompaniment is applied to the music system, a monitor display for displaying a visual image of the music system, and a central processor for executing a process comprising the steps of:

analyzing data associated to the music system to identify the specific style of the accompaniment applied to the music system and to discriminate the particular timbre allotted to the performance part of the music system;

providing a picture of a scenery setting which is set in matching with the identified specific style of the accompaniment such that the picture of the scenery setting visualizes a situation and environment in which the specific style of the accompaniment is applied to the music system;

providing an icon in correspondence to the discriminated particular timbre such that the icon symbolizes playing of the performance part with the allotted timbre; and arranging the icon of the performance part in the picture of the scenery setting to thereby synthesize the visual image of the music system, which is displayed on the monitor display.

32. A music apparatus comprising a sound source for playing a music system containing at least one performance part with a particular timbre while a specific combination of an acoustic effect and an accompaniment style is applied to the music system, a monitor display for displaying a visual image of the music system, and a central processor for executing a process comprising the steps of:

analyzing data associated to the music system to identify the specific combination of the acoustic effect and the accompaniment style applied to the music system and to discriminate the particular timbre allotted to the performance part of the music system;

providing a picture of a scenery setting which is set in matching with the identified specific combination of the acoustic effect and the accompaniment style such that the picture of the scenery setting visualizes a situation and environment inn which the specific combination of the acoustic effect and the accompaniment style is applied to the music system;

providing an icon in correspondence to the discriminated particular timbre such that the icon symbolizes playing of the performance part with the allotted timbre; and arranging the icon of the performance part in the picture of the scenery setting to thereby synthesize the visual image of the music system, which is displayed on the display monitor.

33. A music apparatus comprising a sound source for playing a music system containing at least one performance part with a particular timbre and a lateral pan, a monitor display for displaying a visual image of the music system, and a central processor for executing a process comprising the steps of:

analyzing data representative of the music system to discriminate the particular timbre allotted to the performance part of the music system;

providing an icon in correspondence to the discriminated particular timbre such that the icon symbolizes playing of the performance part with the allotted timbre;

providing a picture of a scenery setting to visualize a situation and environment designed for the music system, the picture of the scenery setting being divided into a sensitive zone and an insensitive zone;

locating the icon of the performance part at a lateral position in the picture of the scenery setting to thereby synthesize the visual image of the music system, which is displayed on the monitor display;

determining the lateral pan of the performance part dependently on the lateral position of the icon when the icon is located within the sensitive zone of the picture; and otherwise determining a fixed lateral pan for the performance part regardless of the lateral position of the icon when the icon is located within the insensitive zone of the picture.

34. A music apparatus comprising a sound source for playing a music system containing at least one performance part with a particular timbre and a lateral pan, a monitor display for displaying a visual image of the music system, and a central processor for executing a process comprising the steps of:

analyzing data associated to the music system to discriminate the particular timbre allotted to the performance part of the music system and to detect the lateral pan applied to the performance part;

providing an icon in correspondence to the discriminated particular timbre such that the icon symbolizes playing of the performance part with the allotted timbre;

providing a picture of a scenery setting to visualize a situation and environment designed for the music system; and locating the icon of the performance part at a lateral position in the picture of the scenery setting in accordance with the detected lateral pan to thereby synthesize the visual image of the music system, which is displayed on the monitor display.

35. A music apparatus comprising a sound source for playing a music system containing at least one performance part with a particular timbre and a sound volume, a monitor display for displaying a visual image of the music system, and a central processor for executing a process comprising the steps of:

analyzing data representative of the music system to discriminate the particular timbre allotted to the performance part of the music system and to detect the sound volume set to the performance part;

providing an icon in correspondence to the discriminated particular timbre such that the icon symbolizes playing of the performance part with the allotted timbre;

providing a picture of a three-dimensional scenery setting to visualize a situation and environment of the music system, the three-dimensional scenery setting having depth positions for accommodating the music system; and locating the icon of the performance part at a depth position in the picture of the three-dimensional scenery setting in accordance with the detected sound volume to thereby synthesize the visual image of the music system, which is displayed on the display monitor.

36. A music apparatus comprising a sound source for playing a music system containing at least one performance part with a particular timbre, a monitor display for displaying a visual image of the playing of the performance part, and a central processor for executing a process comprising the steps of:

analyzing data associated to the music system so as to discriminate the particular timbre allotted to the performance part of the music system;

synthesizing a picture containing an icon designed in correspondence to the discriminated particular timbre;

providing a command to start generation of a sound having the particular timbre according to the data associated to the music system to thereby play the performance part of the music system by means of the sound source; and starting animation of the icon in response to the command so that the icon visualizes the playing of the performance part by means of the monitor display.

37. A music apparatus comprising a sound source for playing a music system composed of performance parts having various timbres, a monitor display for displaying a visual image of the playing of the music system, and a central processor for executing a process comprising the steps of:

analyzing data associated to the music system to discriminate various timbres allotted to respective performance parts of the music system;

synthesizing a picture containing player icons corresponding to the discriminated various timbres and symbolizing the respective performance parts of the music system, and a conductor icon symbolizing a conductor for conducting the music system;

generating sounds by means of the sound source according to the data associated to the music system to thereby play the music system; and animating the conductor icon contained in the picture displayed on the monitor display in matching with the sounds associated to respective performance parts so as to visualize the playing of the music system.

38. A music apparatus comprising a sound source for playing a music system composed of performance parts, a monitor display for displaying a visual image of the music system, and a central processor for executing a process of determining sample music data for use in audibly testing a timbre allotted to a performance part of the music system, wherein the process comprises the steps of:

analyzing data representative of the music system to discriminate timbres allotted to respective performance parts constituting the music system;

providing icons in correspondence to the discriminated timbres such that the icons symbolize playing of the respective performance parts with the allotted timbres;

providing a picture of a scenery setting to visualize a situation and environment designed for the music system;

arranging the icons of the respective performance parts in the picture of the scenery setting to thereby synthesize the visual image of the music system, which is displayed on the monitor display; and selecting one of the icons arranged in the visual image of the music system so as to determine the sample music data which is reproduced by the sound source for audibly testing the timbre allotted to the performance part of the selected icon.

39. A music apparatus comprising a sound source for playing a music system that is composed of performance parts and that is adaptable to perform a music of various genres, and a central processor for executing a process of determining sample music data for use in audibly testing a performance part of the music system, wherein the process comprises the steps of:

identifying a genre of the music to be performed by the music system;

analyzing data representative of the music system to discriminate a timbre allotted to a performance part of the music system; and determining the sample music data according to the identified genre and the discriminated timbre so that the sample music data is reproduced by the sound source for use in audibly testing the performance part.

40. A music apparatus comprising a sound source for playing a music system that is composed of performance parts and that is configurable to perform a music at a variable tempo, and a central processor executing a process of determining sample music data for use in audibly testing a performance part of the music system, wherein the process comprises the steps of:

specifying a tempo of the music to be performed by the music system;

analyzing data representative of the music system to discriminate a timbre allotted to a performance part of the music system; and determining the sample music data according to the specified tempo and the discriminated timbre so that sample music data is reproduced by the sound source for audibly testing the performance part.

41. A music apparatus comprising a sound source for playing a music system composed of performance parts, a monitor display for displaying a visual image of the music system, and a central processor for executing a process of determining sample music data for use in audibly testing performance parts of the music system, wherein the process comprises the steps of:

analyzing data representative of the music system to discriminate timbres allotted to respective performance parts constituting the music system;

providing icons in correspondence to the discriminated timbres such that the icons symbolize playing of the respective performance parts with the allotted timbres;

providing a picture of a scenery setting to visualize a situation and environment designed for the music system, the picture containing a melody area and a backing area;

specifying a location of each icon of each performance part in either of the melody area and the backing area on the picture of the scenery setting to thereby synthesize the visual image of the music system, which is displayed on the monitor display, some performance part being located in the melody area for playing a melody while other performance part being located in the backing area for backing the melody; and selecting one of the icons arranged in the visual image of the music system so as to determine the sample music data according to the timbre allotted to the performance part of the selected icon and according to the location of the selected icon relative to the melody area and the backing area, so that the sample music data is reproduced by the sound source for audibly testing the performance part of the selected icon.

42. An apparatus for displaying a visual image of a music system that is constructed to play at least one performance part with a particular timbre and that is acoustically characterized by a specific effect, the apparatus comprising:

means for analyzing data representative of the music system to discriminate the specific effect applied to the music system and to discriminate the particular timbre allotted to the performance part of the music system;

means for providing a picture of a virtual setting which is set in matching with the discriminated specific effect such that the picture of the virtual setting visualizes a situation and environment in which the music system should be played with the specific effect;

means for providing an icon in correspondence with the discriminated particular timbre such that the icon symbolizes playing of the performance part with the allotted timbre; and means for arranging the icon of the performance part in the picture of the virtual setting to thereby synthesize the visual image of the music system.

43. An apparatus for displaying a visual image of playing at least one performance part with a particular timbre in a music system, the apparatus comprising:

means for analyzing data representative of the music system to discriminate the particular timbre allotted to the performance part of the music system;

means for synthesizing a picture containing an icon designed in correspondence with the discriminated particular timbre;

mean for providing a command to start generation of a sound having the particular timbre according to the data of the music system to thereby play the performance part of the music system; and means for starting animation of the icon in response to the command so that the icon visualizes the playing of the performance part with the allotted timbre.

44. An apparatus for determining a sample of music data for use in auditioning a timbre allotted to a performance part of a music system, the apparatus comprising:

means for analyzing data representative of the music system to discriminate timbres allotted to performance parts constituting the music system;

means for providing icons in correspondence with the discriminated timbres such that the icons symbolize playing of the performance parts with the allotted timbres;

means for providing a picture of a virtual setting to visualize a situation and environment of the music system;

means for arranging the icons of the performance parts in the picture of the virtual setting to thereby synthesize a visual image of the music system; and means for selecting one of the icons arranged in the visual image of the music system so as to determine a sample of music data for use in auditioning the timbre allotted to the performance part of the selected icon.

* * * * *